United States Patent [19]

Bissonette

[11] 4,097,278

[45] Jun. 27, 1978

[54] REDOX AMPLIFICATION PROCESS EMPLOYING A COMBINATION OF OXIDIZING AGENTS

[75] Inventor: Vernon L. Bissonette, Brockport, N.Y.

[73] Assignee: Eastman Kodak Company, Rochester, N.Y.

[21] Appl. No.: 730,914

[22] Filed: Oct. 8, 1976

Related U.S. Application Data

[63] Continuation-in-part of Ser. No. 609,880, Sep. 2, 1975, abandoned.

[51] Int. Cl.[2] ..... G03C 7/16; G03C 7/00; G03C 5/32; G03C 5/24

[52] U.S. Cl. ..... 96/22; 96/3; 96/29 D; 96/48 R; 96/49; 96/51; 96/54; 96/55; 96/56.5; 96/60 R; 96/61 R

[58] Field of Search ..... 96/3, 29 D, 54, 55, 96/51, 60 R, 48 R, 49, 56.5, 22, 48 PD, 61 R

[56] References Cited

U.S. PATENT DOCUMENTS

| | | | |
|---|---|---|---|
| 3,684,511 | 8/1972 | Weyde et al. | 96/48 R |
| 3,748,138 | 7/1973 | Bissonette | 96/66.3 |
| 3,764,490 | 10/1973 | Chambers | 204/54 R |
| 3,765,891 | 10/1973 | Travis | 96/55 |
| 3,772,020 | 11/1973 | Smith | 96/60 BF |
| 3,773,510 | 11/1973 | Fisch | 96/60 BF |
| 3,776,730 | 12/1973 | Matejec et al. | 96/55 |
| 3,822,129 | 7/1974 | Dann et al. | 96/60 R |
| 3,826,652 | 7/1974 | Bissonette | 96/48 PD |
| 3,834,907 | 9/1974 | Bissonette | 96/74 |
| 3,841,873 | 10/1974 | Mowrey et al. | 96/60 R |
| 3,846,130 | 11/1974 | Purol et al. | 96/55 |
| 3,847,619 | 11/1974 | Bissonette et al. | 96/76 R |
| 3,856,524 | 12/1974 | Bissonette | 96/35 |
| 3,862,842 | 1/1975 | Bissonette | 96/55 |

FOREIGN PATENT DOCUMENTS

| | | |
|---|---|---|
| 777,635 | 6/1957 | United Kingdom. |
| 1,329,444 | 9/1973 | United Kingdom. |

OTHER PUBLICATIONS

"Image Amplification Systems" Research Disclosure vol. 116, No. 11660, pp. 109-114, 12/1973.

*Primary Examiner*—J. Travis Brown
*Assistant Examiner*—Richard L. Schilling
*Attorney, Agent, or Firm*—Carl O. Thomas

[57] ABSTRACT

My invention is directed to a process of forming dye images. I accomplish this through a first redox amplification reaction in which a cobalt (III) complex oxidizing agent enters into a redox reaction with a reducing agent at the site of a catalyst image. A second redox amplification reaction follows in which a peroxide oxidizing agent is employed along with dye-image-generating reducing agent to form a dye image corresponding to the pattern of the catalyst.

53 Claims, 10 Drawing Figures

REDOX AMPLIFICATION PROCESS EMPLOYING A COMBINATION OF OXIDIZING AGENTS

CROSS-REFERENCE TO RELATED APPLICATIONS

This is a continuation-in-part of U.S. Ser. No. 609,880, filed Sept. 2, 1975, now abandoned.

FIELD OF THE INVENTION

The present invention is directed to a novel process for producing photographic dye images. More specifically, the present invention is directed to a process for producing photographic dye images through a redox amplification reaction using an imagewise distribution of a heterogeneous catalyst. Still more specifically, this invention is directed to a process for producing photographic dye images through a redox amplification reaction using a combination of oxidizing agents.

BACKGROUND OF THE INVENTION

It is old and well-known in the photographic art to reduce silver halide grains bearing a latent image (hereinafter also designated AgX.) with a dye-image-generating reducing agent (hereinafter also designated DIGRA), such as a color-developing agent, capable of providing a dye-image-generating reaction product (hereinafter also designated DIGRP). For example, color-developing agents react with silver halide grains bearing a latent image to form silver and oxidized color-developing agent. The oxidized color-developing agent can then react with a photographic color coupler to form a dye image. In a variation, a black-and-white developing agent is employed frequently in combination with the color-developing agent. The black-and-white developing agent can, under properly chosen conditions, be used as a cross-oxidizing agent which reacts with the silver halide to produce a silver image and oxidized black-and-white developing agent which in turn reacts with the color-developing agent so that the black-and-white developing agent is regenerated while the color-developing agent is oxidized. The net reaction can be expressed symbolically as indicated below in Equation 1:

$$\text{DIGRA} + \text{AgX.} \rightarrow \text{DIGRP} + \text{Ag}^{\circ} \qquad (1)$$

In my U.S. Pat. No. 3,862,842, issued Jan. 28, 1975, I teach a process for producing dye-image-generating reaction products through a redox amplification reaction. In that process I react an inert transition metal complex oxidizing agent, which in one preferred form can be a cobalt(III) complex, with a dye-image-generating reducing agent, such as a color-developing agent. This reaction requires a catalyst. I have taught the use of an imagewise-distributed heterogeneous catalyst, such as catalytic metal or carbon image. In one preferred form the catalyst image can be a photographic silver image, although the silver can be present in such a low concentration that it may not be readily visible. Unlike the development of silver halide with a color-developing agent, as described in Equation 1, the dye image which can be produced by my redox amplification process is not stoichiometrically limited by the original catalyst image. Accordingly, my redox amplification process has proven quite useful in allowing dye images of high maximum density to be formed using relatively low concentrations of imagewise-distributed catalysts, such as photographic silver. Using a cobalt (III) complex, hereinafter also designated as Co(III) CMPLX, the redox amplification can be symbolically expressed by Equation 2, as follows:

$$\textit{DIGRA} + \text{Co(III)}\ \textit{CMPLX} \xrightarrow[\text{Cat.}]{\text{Hetero.}} \textit{DIGRP} \qquad \text{(Eq. 2)}$$

It is apparent that when the heterogeneous catalyst of Equation 2 is metallic silver and the dye-image-generating reducing agent is a color-developing agent, it is possible (a) to develop an exposed silver halide photographic element and (b) to amplify the silver image by forming a dye image concurrently. In this instance, a dye-image-generating reaction product is being formed by the reactions of both Equations 1 and 2, although most of the dye image is formed by the latter reaction.

In addition to my U.S. Pat. No. 3,862,842, cited above, I have also disclosed redox amplification reactions using a cobalt(III) complex as an oxidizing agent in my U.S. Pat. Nos. 3,826,652 issued July 30, 1974, 3,834,907 issued Sept. 10, 1974, and 3,847,619 issued Nov. 12, 1974, for example. My present process constitutes an improvement on conventional redox amplification processes using a cobalt(III) complex and is fully compatible with those processes disclosed in my above-noted patents, herein incorporated by reference. Travis, U.S. Pat. No. 3,765,891 issued Oct. 16, 1973, teaches a redox amplification process using a cobalt(III) complex which is compatible with my present process and is herein incorporated by reference.

In the above-noted patents, the redox amplification reactions using a cobalt(III) complex as an oxidizing agent have been generally carried out in the presence of a sequestering agent, such as ethylenediaminetetraacetic acid, which is capable of complexing with cobalt(II) to form a soluble reaction product. In this way, any risk of spontaneous oxidation of the dye-image-generating reducing agent, e.g., color-developing agent, by reoxidized cobalt reaction products is avoided, since the soluble cobalt(II) reaction product is free to diffuse from the element being processed.

It is, of course, generally appreciated in the art that cobalt(III) complexes can be used in photographic processes for purposes other than formation of a photographic dye image. For example, I have also taught in may U.S. Pat. No. 3,748,138 issued July 24, 1973, to accelerate the development of silver halide by cobalt(III) complexes as development accelerators. It is also known in the art to employ cobalt(III) complexes in the bleaching of photographic silver images. This is taught, for example, in British Pat. No. 777,635. In my U.S. Pat. 3,923,511, issued Dec. 2, 1975, I employ cobalt(III) complexes for both silver bleaching and redox amplification to form a dye image. In my U.S. Pat. No. 3,856,524, issued Dec. 24, 1974, I employ a cobalt(III) complex to tan a hydrophilic colloid such as gelatin.

It is known in the art to produce dye-image-generating reaction products through a redox amplification reaction of a dye-image-generating reducing agent and a peroxide oxidizing agent (PEROXY) in the presence of a catalyst. This reaction can be symbolically expressed by Equation 3, as follows:

$$\text{DIGRA} + \text{PEROXY} \rightarrow \text{DIGRP}$$

The formation of photographic dye images through the use of peroxide oxidizing agents in a redox amplification reaction is generally well-known in the art. For example, Matejec, U.S. Pat. No. 3,674,490 issued July 4, 1972, teaches the forming of a photographic silver image which can then be used to catalyze the redox reaction of a peroxide oxidizing agent and a color-developing agent. Useful catalytic materials are not limited to photographic silver images, but include noble metals of Groups I*b* and VIII of the Periodic Table generally. Matejec, U.S. Pat. No. 3,776,730 issued December 4, 1973, teaches the use of light-destructible peroxidase and catalase enzymes to catalyze the peroxide redox reaction. British Pat. No. 1,329,444 published Sept. 5, 1973, teaches forming a peroxide redox reaction catalyst by image-exposing a simple or complex salt of a heavy metal of Group VI*b*, VII*b* or VIII of the Periodic Table with a mono- or polybasic carboxylic acid. Weyde et al, U.S. Pat. No. 3,684,511 issued Aug. 15, 1972, teach imagewise-exposing an iodoform or derivative compound to form a catalyst imagewise.

One of the significant disadvantages encountered in using peroxide redox reactions to generate photographic dye images has centered around the necessity of providing a clean catalyst surface. This is pointed out in *Research Disclosure,* Vol. 116, Item No. 11660, titled "Image Amplification Systems", published December, 1973. A number of materials are disclosed which tend to become adsorbed to the surface of catalytic noble metal nuclei and thereby to interfere with peroxide oxidizing agent redox reactions with color-developing agents. These include adsorbed stabilizers, antifoggants and spectral-sensitizing dyes. Azoles and thiazoles which are free from mercaptan and ionic iodide moieties are taught to be useful without fouling catalytic surfaces. Mercaptotetrazoles, -oxazoles, and -imidazoles are taught to be avoided. Since peroxide-containing amplifier solutions may be poisoned by bromide ions or antifoggants carried over from conventional development solutions, it is taught to limit developing solutions to potassium bromide or antifoggant concentrations no greater than 1 gram per liter.

It is known in the art that photographic dye images can be produced using photographic silver images as a catalyst for a redox amplification reaction using a cobalt(III) complex oxidizing agent or, alternatively, a peroxide oxidizing agent. It is taught alternatively to process photographic elements containing photographic silver images with cobalt(III) complex oxidizing agent or a peroxide oxidizing agent in my U.S. Pat. No. 3,834,907, cited above, and in Dunn, U.S. Pat. No. 3,822,129 issued July 2, 1974, herein incorporated by reference.

Mowrey et al U.S. Pat. No. 3,841,873, issued Oct. 15, 1974, the incorporation of a strong oxidizing agent in a redox amplification bath, such as a bath containing a cobalt(III) complex. The function of the strong oxidizing agent is to spontaneously react with any color developing agent carried over into the amplification bath from a prior developer bath. The developing agents and strong oxidizing agents, i.e. alkali metal peracids and ferricyanides, employed by Mowrey et al are not essentially inert to oxidation-reduction in the absence of a catalyst, nor would they be useful for the purpose taught by Mowrey et al if this characteristic were in evidence.

SUMMARY OF THE INVENTION

In one aspect, my invention is directed to a process of forming an image which comprises bringing a cobalt(III) complex and a reducing agent together in contact with an image pattern of a heterogeneous catalyst, wherein the oxidizing agent and the reducing agent are chosen so that they are essentially inert to oxidation-reduction in the absence of the heterogeneous catalyst. The cobalt(III) complex and the reducing agent selectively react at the site of the heterogeneous catalyst to produce cobalt(II) as an immobile reaction product in a pattern conforming to the heterogeneous catalyst image pattern. I bring into material contact a peroxide oxidizing agent, a dye-image-generating reduction agent capable of producing a dye-image-generating reaction product and the immobile cobalt(II) reaction product, wherein the peroxide oxidizing agent and the dye-image-generating reducing agent are chosen so that they are essentially inert to oxidation-reaction in the absence of a catalyst, and selectively react the peroxide oxidizing agent and the dye-image-generating reducing agent in a pattern conforming to the heterogeneous catalyst image pattern to permit a corresponding dye image to be formed.

In another aspect, I form the heterogeneous catalyst image pattern, which is thereafter employed as described above.

In one specific, illustrative form, my invention can be practiced by developing a photographic element having at least one silver halide emulsion layer bearing a latent image. Where the developing agent is a color-developing agent (COL-DEV), it is a dye-image-generating reducing agent as well and reacts with the latent image bearing silver halide to form oxidized color developer ($COL\text{-}DEV_{ox}$), a dye-image-generating reaction product which, when reacted with a color coupler, forms a dye (hereinafter designated DYE-1 to differentiate this dye from that formed by other reactions). This is set forth symbolically below in Equations 5*a* and 5*b*, hereinafter referred to collectively as Equations 5:

$$\text{COL-DEV} + \text{AgX.} \rightarrow \text{COL-DEV}_{ox} + \text{Ag}^{\circ} \qquad (5a)$$

$$\text{COL-DEV}_{ox} + \text{Coupler} \rightarrow \text{DYE-1} \qquad (5b)$$

Using the silver image that is formed as a catalyst, I associate therewith a cobalt(III) complex which permanently releases ligands upon reduction, such as a cobalt(III) complex having a coordination number of 6 and monodentate or bidentate ligands, at least four of which are ammine ligands, e.g., a cobalt hexammine. As a dye-image-generating reducing agent to be reacted with the cobalt(III) complex in the presence of the silver image catalyst, I can again use a color-developing agent. The cobalt(III) complex and the color-developing agent react to form ultimately a dye, hereinafter designated DYE-2, which amplifies the original silver image and typically provides more dye than is generated in the reactions of Equations 5. The cobalt(III) complex redox amplification reactions can be expressed symbolically by Equations 6*a* and 6*b*, hereinafter referred to collectively as Equations 6:

$$\text{COL-DEV} + \text{Co(III)CMPLX} \rightarrow \text{COL-DEV}_{ox} + \text{CO(II)RP} \qquad (6a)$$

$$\text{COL-DEV}_{ox} + \text{Coupler} \rightarrow \text{DYE-2} \qquad (6b)$$

By bringing a peroxide oxidizing agent into contact with the color-developing agent at the site of the silver image, I can also form dye (hereinafter designated DYE-3) as a result of a peroxide redox amplification reaction. This reaction can be expressed symbolically by Equations 7*a* and 7*b*, hereinafter collectively referred to as Equations 7:

$$\text{COL-DEV} + \text{PEROXY} \rightarrow \text{COL-DEV}_{ox} \quad (7a)$$

$$\text{COL-DEV}_{ox} + \text{Coupler} \rightarrow \text{DYE-3} \quad (7b)$$

This reaction then opens up a third reaction path for the formation of image dye in a redox amplification reaction.

I have discovered quite unexpectedly that a fourth dye-forming reaction path can be provided in this illustrative form of my redox amplification process. I have discovered that it is possible to form an immobile cobalt(II) reaction product, hereinafter designated Co(II)RP, in an image pattern corresponding to the heterogeneous catalyst image pattern (in this instance the silver image pattern). The immobile cobalt(II) reaction product is then capable of interacting with the peroxide oxidizing agent to provide ultimately additional dye. While I do not wish to be bound by any particular theory to account for the interaction of the cobalt(II) reaction product and the peroxide oxidizing agent, I believe that the peroxide oxidizing agent oxidizes the cobalt(II) reaction product to produce a cobalt(III) oxidizing agent, hereinafter designated Co(III)OA, which is capable of spontaneously reacting with the dye-image-generating reducing agent, in this instance color developing agent, to produce additional dye, hereinafter designated DYE-4, and to regenerate the immobile cobalt(II) reaction product. This fourth dye-generating reaction sequence can be symbolically expressed by Equations 8*a*, 8*b* and 8*c*, hereinafter collectively designated Equations 8:

$$\text{Co(II)RP} + \text{PEROXY} \rightarrow \text{Co(III)OA} \quad (8a)$$

$$\text{Co(III)OA} + \text{COL-DEV} \rightarrow \text{COL-DEV}_{ox} + \text{Co(II)RP} \quad (8b)$$

$$\text{COL-DEV}_{ox} + \text{Coupler} \rightarrow \text{DYE-4} \quad (8c)$$

Note the consumption of cobalt(II) reaction product in Equation 8(*a*) and the regeneration of cobalt(II) reaction product in Equation 8(*b*).

From the foregoing description of one specific, illustrative form of my process, certain general advantages of my redox amplification process can be readily appreciated. I have discovered quite surprisingly that, in employing peroxide and cobalt(III) complex oxidizing agents in a single process, an unexpected interaction is obtained which allows for more and faster generation of a dye image starting with a given heterogeneous catalyst image or, stated another way, the formation of a dye image of a desired density can be attained using lower levels of imagewisedistributed heterogeneous catalyst. In a specific application, this indicates that silver halide photographic elements can be employed in the practice of my process having still lower silver levels than have been heretofore feasible in conventional redox amplification reactions.

I have additionally discovered that peroxide oxidizing agents can be usefully employed in redox amplification reactions even when no suitable heterogeneous catalyst for this oxidizing agent is initially present in a photographic element to be processed. I have observed, for example, that photographic elements bearing a silver image can be usefully processed using a peroxide oxidizing agent even when the silver image has been poisoned as a catalyst for the direct reaction of a peroxide oxidizing agent reaction with a dye-image-generating reducing agent. Referring to the equations above, whereas a person skilled in the art might consider a peroxide oxidizing agent to serve no useful purpose when no suitable catalyst is present for the reaction of Equations 3 and 7, I have found unexpectedly that the presence of a peroxide oxidizing agent nevertheless provides a further enhancement of amplification, since the reactions of Equations 8, for example, require no silver catalyst for the peroxide to react. Stated another way, I have observed that where a redox amplification reaction is undertaken using a cobalt(III) complex as an oxidizing agent and the heterogeneous catalyst for this reaction has been chosen so that it is not a catalyst for the corresponding peroxide oxidizing agent reaction, an enhanced result can nevertheless be obtained by employing a peroxide oxidizing agent in combination with the cobalt(III) complex oxidizing agent.

It has been known in the art that cobalt(III) complexes employed as oxidizing agents in redox amplification reaction can react with dye-image-generating reducing agents at a heterogeneous catalyst surface to oxidize the dye-image-generating reducing agent to a dye-image-generating reaction product. I have discovered that an immobile cobalt(II) reaction product can be formed which is useful as an active catalyst for a peroxide redox amplification catalyst. Whereas cobalt(III) complexes have been heretofore consumed in a stoichiometric relationship to the dye produced during a redox amplification reaction, I have observed that the cobalt(II) reaction products formed from an initially consumed cobalt(III) complex are first converted to a cobalt(III) oxidizing agent by a peroxide oxidizing agent and then regenerated, as is illustrated by Equations 8. The regenerated cobalt(II) reaction product is then available to repeat the cycle. Thus, in my process neither the quantities of heterogeneous catalyst nor the amount of cobalt(II) produced by the cobalt redox amplification step stoichiometrically limits the density of the photographic dye image which can be produced.

While I have described my invention with reference to a specific illustration in which four separate dye-generating reactions are employed, it should be readily apparent that the advantages of my process can be realized even though a lesser number of dye-forming reactions are employed. For example, I specifically contemplate that my process can begin with the heterogeneous catalyst image's being preformed or with the use of a black-and-white developing agent's being substituted for the color-developing agent in silver halide development. In this instance, DYE-1 of Equations 5 is not formed. In addition, I specifically contemplate performing my process under conditions where no suitable heterogeneous catalyst for the reactions of Equations 7 to form DYE-3 is present. Under these conditions, the advantages of my process are still realized since I am still obtaining DYE-2 and DYE-4, whereas the reactions leading to DYE-4 are unexpected. If a reducing agent other than a dye-image-generating reducing agent, such as a black-and-white silver halide developing agent, is substituted for the color-developing agent in Equations 6, DYE-2 is not formed; however, the process is still highly useful in forming photographic dye images, since DYE-4 can still be formed if color developing agent or another dye-image-generating reducing agent is subsequently made available.

One of the significant advantages of my process is that the peroxide oxidizing agent can be employed in my process even though one or a variety of materials are present that would be incompatible with conventional peroxide amplification reactions using a silver or other heterogeneous catalyst surface. For example, I specifically contemplate that my amplification process can be practiced in the presence of bromide concentrations which are incompatible with heterogeneous catalysis of peroxide amplification reactions.

It is a further advantage of my invention that it is quite adaptable to a variety of processing approaches. In one approach, a photographic element comprised of at least one silver halide emulsion layer is developed to form a heterogeneous catalyst image, in this instance a silver image. With formation of the heterogeneous catalyst image, it is now possible to perform the cobalt(III) complex redox amplification reaction and the peroxide redox amplification reaction, provided the catalyst for this latter amplification reaction has not been poisoned or is not otherwise unsuitable. In any event, once the cobalt(III) complex redox amplification reaction has at least begun to generate the immobile cobalt(II) reaction product in an image pattern conforming to the original heterogeneous catalyst image pattern, the cobalt(II) reaction product and the peroxide oxidizing agent can interact to form additional dye. In one form of practicing my process, the steps of heterogeneous catalyst image generation, cobalt(III) complex redox amplification and peroxide redox amplification, including cobalt(II) reaction product and peroxide interaction, can be performed sequentially in separate conventional processing solutions. In an alternative form, the silver halide development and cobalt(III) complex redox amplification steps can be combined and the peroxide redox amplification step performed thereafter. In another alternative form, the heterogeneous catalyst image can be first formed in a separate processing step and the cobalt(III) complex and peroxide oxidizing agent redox amplifications performed concurrently in a single processing solution. In still another form, development and both amplification steps can be performed in a single processing solution.

It is a still further surprising and advantageous feature of my invention that a compound which is capable of complexing with cobalt to form tridentate or higher dentate chelate ligands can produce enhanced photographic dye image densities when incorporated in developing solutions employed in the practice of my invention. I have further found unexpectedly that these multidentate ligand-forming compounds can be usefully employed during peroxide amplification to minimize background stain. The utility of the multidentate ligand-forming compounds in the peroxide amplification step is surprising, since these compounds can interact with cobalt(II) to produce a soluble, noncatalytic complex. Surprisingly, the multidentate ligand-forming compounds have a useful effect during both development and peroxide amplification. While I prefer to limit the concentration of these multidentate ligand-forming compounds during initial formation of the cobalt(II) reaction product (during cobalt(III) complex redox amplification), so that the formation of an immobile cobalt(II) reaction product is favored, low levels of these compounds can be usefully present during cobalt(III) complex redox amplification.

Still other surprising and advantageous features of my invention will become apparent from the following detailed description. For example, advantages which are best illustrated by reference to a particular mode of practicing my invention are discussed below.

FIG. 1 is a plot of four observed and one calculated characteristic curves (or H and D curves) for a red-sensitized emulsion layer wherein the curve is that produced by a cyan dye image.

FIGS. 2 through 9 of the drawings are in each instance characteristic curves (or H and D curves) for blue, green and red light-recording layers of a photographic element, wherein the blue layer characteristic curve B is that produced by a yellow image dye, the green layer characteristic curve G is that produced by a magenta image dye, and the red layer characteristic curve R is that produced by a cyan image dye.

FIG. 10 is a plot of four observed characteristic curves formed by a magenta image dye transferred from an emulsion layer containing a redox dye-releaser.

DESCRIPTION OF PREFERRED EMBODIMENTS

Figure 1:
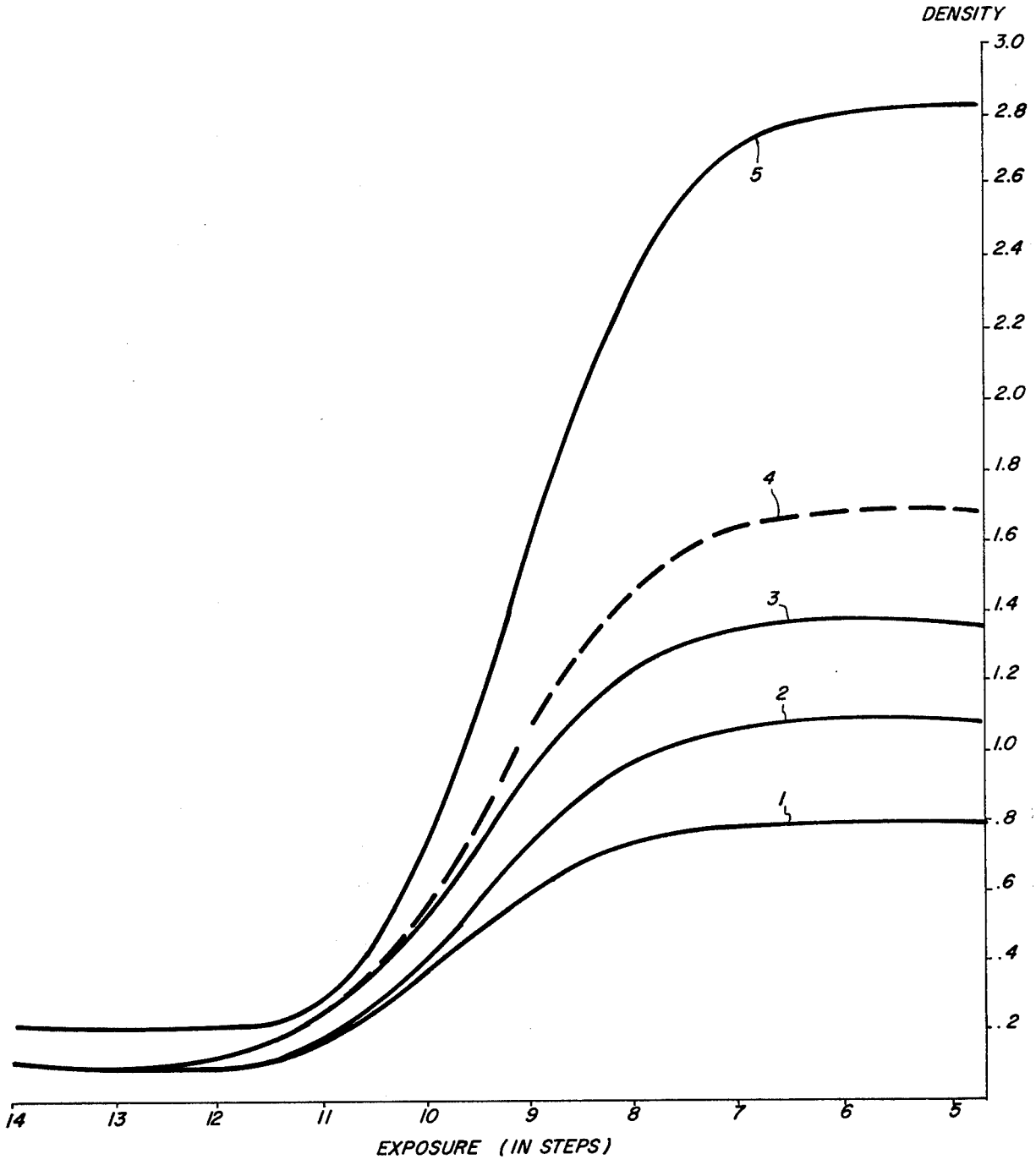

While sub-headings are provided for convenience, to appreciate fully the elements of my invention it is intended that my disclosure be read and interpreted as a whole.

THE HETEROGENEOUS CATALYST

In one specific form, the practice of my invention begins by providing an element bearing a silver image. The silver image can be conveniently formed by image-wise-exposing and developing a photographic element comprised of at least one radiation-sensitive silver halide emulsion layer. Development of the photographic silver image can be achieved by any convenient conventional processing approach. In general, the photographic element can be developed after exposure in a developer solution containing a developing agent, such as a polyhydroxybenzene, aminophenol, paraphenylenediamine, pyrazolidone, pyrazolone, pyrazolone, pyrimidine, dithionite, hydroxylamine, hydrazine or other conventional developing agent. A variety of suitable conventional developing agents are disclosed, for example, in *The Theory of the Photographic Process* by Mees and James, 3rd Edition, Chapter 13, titled "The Developing Agents and Their Reactions", published by MacMillan Company (1966), the disclosure of which is here incorporated by reference.

The photographic developers employed in the practice of my invention can include, in addition to conventional developing agents, other conventional components. The developers are typically aqueous solutions, although organic solvents, such as diethylene glycol, can also be included to facilitate the solvency of organic components. Since the activity of developing agents is frequently pH-dependent, it is contemplated to include activators for the developing agent to adjust the pH. Activators typically included in the developer are sodium hydroxide, borax, sodium metaborate, sodium carbonate and mixtures thereof. Sufficient activator is typically included in the developer to maintain an alkaline developer solution, usually at a pH above 8.0 and, most commonly, above 10.0 to a pH of about 13. To reduce aerial oxidation of the developing agent and to avoid the formation of colored reaction products, it is commonplace to include in the developer a preservative, such as sodium sulfite. It is also common practice to include in the developer a restrainer, such as potassium bromide, to restrain nonimage development of the silver halide with the consequent production of development fog. To reduce gelatin swelling during development, compounds such as sodium sulfate may be incorporate into the developer. Also compounds such as sodium thiocyanate may be present to reduce granularity. Generally, any photographic developer for silver halide photographic emulsions can be employed in the practice of my invention. Specific illustrative photographic developers are disclosed in the *Handbook of Chemistry and Physics,* 36th Edition, under the title "Photographic Formulae" at page 3001 et seq. and in *Processing Chemicals and Formulas,* 6th Edition, published by Eastman Kodak Company (1963), the disclosures of which are here incorporated by reference.

In one form of my invention, I specifically contemplate incorporating into the developer solution a sequestering or chelating agent for the purpose of increasing the density of the photographic dye image which is ultimately produced. The chelating agent can also be used to control background dye densities, that is, stain attributable to unwanted dye formation. I have observed that inclusion of ethylenediaminetetraacetic acid, which is known to form a multidentate ligand with cobalt, enhances the density of the photographic dye image formed according to my process. The effectiveness of ethylenediaminetetraacetic acid for this purpose is surprising, since it is believed that ethylenediaminetetraacetic acid forms a stable, soluble complex with cobalt which will not spontaneously oxidize dye-imagegenerating reducing agent if the cobalt is reoxidized to its III oxidation state. Other compounds which similarly chelate with cobalt include sodium metaphosphate, sodium tetraphosphate, 2-hydroxypropylenediaminetetraacetic acid, and the like. While any quantity of sequestering agent can be employed which will produce an effective enhancement of the photographic dye image, I generally prefer to employ the sequestering agent in the developer in a concentration of from 1 mg/liter up to 10 grams per liter.

As employed herein, the term "multidentate ligand" is defined as a ligand of a cobalt complex which forms three or more coordination bonds with cobalt. Tridentate and higher dentate ligands of cobalt are thus multidentate ligands. A monodentate or bidentate ligand of a cobalt complex is bonded to cobalt at one or two coordination bonding sites, respectively.

After photographic elements employed in the practice of my invention have been developed according to the procedure described above, they can be immediately subjected to a cobalt(III) complex redox amplification step or, alternatively, the photographic elements can be fully processed in a conventional manner to form a stable, viewable photographic image. For example, after development of the photographic silver image, the photographic element can be processed through stop, fix and rinse baths prior to being subjected to the amplification steps of my process.

Instead of developing a photographic silver image, it is, of course, possible to use any heterogeneous catalyst image which can be employed in cobalt(III) complex redox amplification reactions. Specific heterogeneous catalysts and the considerations for their selection are fully discussed in my earlier U.S. Pat. No. 3,862,842, cited above and incorporated by reference. As employed herein the term "heterogeneous catalyst" refers to catalysts of the type indicated above which accelerate the redox reaction of the cobalt(III) complex and a reducing agent in one phase by providing a catalytic surface for the reaction at the phase boundary. Typically the heterogeneous catalyst is in the solid phase in a form providing a substantial surface area, such as in a particulate form, while the redox reactants are in a liquid phase in contact therewith.

I generally prefer to employ as heterogeneous catalysts the metals or the chalcogens of Group VIII or IB elements. I also contemplate the use of carbon or activated charcoal as a heterogeneous catalyst. Specific illustrative catalysts include metals such as platinum, copper, silver, gold and chalcogens such as silver sulfides, silver oxides, nickel sulfide, cuprous sulfide, and cupric oxide. While several of the above are referred to as chalcogens, it is understood that, in some instances, an equilibrium mixture may be present in the element being processed, such as a mixture of silver hydroxide and silver oxide.

Although not essential to the practice of my process, I prefer in at least some applications to employ heterogeneous catalysts which are both catalysts for the cobalt(III) complex redox amplification reaction and a peroxide redox amplification reaction. Generally, the same criteria apply for selecting catalysts for the peroxide redox amplification reaction as for the cobalt(III) complex redox amplification reaction. The metals and chalcogens of Group VIII and IB elements specifically identified above as heterogeneous catalysts can also be catalysts for the peroxide redox amplification reaction. In this connection, it should be pointed out that a heterogeneous catalyst may initially be a catalyst for both the cobalt(III) complex and peroxide redox amplification reactions, but owing to the greater susceptibility of the peroxide redox amplification reaction to catalyst poisoning, the heterogeneous catalyst under the actual conditions of use may be acting as a catalyst for only the cobalt(III) complex redox amplification reaction.

I specifically contemplate that materials which are catalysts for the peroxide redox amplification reaction only can be employed in combination with the heterogeneous catalysts for the cobalt(III) complex redox amplification. That is, I contemplate that any known peroxide redox amplification catalyst which is suitably compatible with the specific processing condition and materials can be employed in the practice of my process. For example, I contemplate using, in combination with the heterogeneous catalysts described above for the cobalt(III) complex redox amplification reaction, materials such as manganese, molybednum, zinc oxide, chromium oxide, zinc sulfide, manganese oxide and similar metals and metal chalcogens which are either exclusively catalysts for the peroxide redox amplification reaction or more effective in catalyzing this reaction than the cobalt(III) complex redox reaction. These and other known peroxide amplification catalysts, such as disclosed, for example, in U.S. Pat. Nos. 3,684,511, 3,764,490 and 3,776,730, and as well as British Pat. No. 1,329,444, all cited above, can be employed in the manner and at or below the concentrations taught by these patents.

In one form, the practice of my process can begin with a photographic element bearing an image pattern of a heterogeneous catalyst for the cobalt(III) complex redox amplification reaction. The formation of the heterogeneous catalyst image can take any desired convenient conventional form. In one specific form, the photographic element can contain a silver image. The silver image can result from a fully processed or merely fully developed silver halide photographic element. In some instances, it may be convenient to employ a silver image which is formed only by exposure of a silver halide photographic element (i.e. which has not received processing subsequent to exposure), since very little heterogeneous catalyst is necessary to practice my invention. Where the photographic element bears a silver image that has been formed by development with a color-developing agent in the presence of a color coupler, some dye may be already associated with the heterogeneous catalyst image.

THE FIRST AMPLIFICATION

In one form, after the heterogeneous catalyst image is present in the photographic element, I introduce the element into an aqueous alkaline amplification bath, hereinafter referred to as a first amplification bath or solution, for the purpose of performing the cobalt(III) complex redox amplification step.

The cobalt(III) complexes employed are chosen from among those which permanently release ligands upon reduction. As is well-understood in the art, cobalt(III) complexes release ligands upon reduction. The cobalt(III) complexes which I employ are those which upon reoxidation following reduction are not regenerated. Where monodentate or bidentate ligands are initially present in a cobalt(III) complex, these ligands are generally so mobile that, once released, they migrate away from the cobalt(II) and cannot be recaptured when the cobalt is reoxidized to cobalt(III). I accordingly prefer to employ cobalt(III) complexes in which each of the ligands present is a monodentate and/or bidentate ligand. Such complexes are disclosed, for example, in my U.S. Pat. Nos. 3,834,907, 3,847,619, 3,862,842, 3,856,524 and 3,826,652 and in Travis, U.S. Pat. No. 3,765,891, all of which are cited above.

Particularly preferred cobalt(III) complexes useful in this amplification step of my process have a coordination number of 6 and have mono- or bidentate ligands chosen from among ligands such as alkylenediamine, ammine, aquo, nitrate, nitrite, azide, chloride, thiocyanate, isothiocyanate, carbonate and similar ligands commonly found in cobalt(III) complexes. Especially useful are the cobalt(III) complexes comprising four or more ammine ligands, such as $[Co(NH_3)_6]X$, $[Co(NH_3)_5H_2O]X$, $[Co(NH_3)_5CO_3]X$, $[Co(NH_3)_5Cl]X$ and $[Co(NH_3)_4CO_3]X$, wherein X represents one or more anions determined by the charge neutralization rule and X preferably represents a polyatomic organic anion.

As has been recognized in the art, with many complexes, such as cobalt hexammine, the anions selected can substantially affect the reducibility of the complex. The following ions are listed in the order of those which give increasing stability to cobalt hexammine complexes: bromide, chloride, nitrite, perchlorate, acetate, carbonate, sulfite and sulfate. Other ions will also affect the reducibility of the complex. These ions should, therefore, be chosen to provide complexes exhibiting the desired degree of reducibility. Some other useful anions include thiocyanate, dithiocyanate and hydroxide. Neutral complexes, such as cobalt trinitrotriammine, are useful, but positively charged complexes are generally preferred.

In certain highly preferred embodiments, the cobalt(III) complexes used in this invention contain at least three amine ($NH_3$) ligands and/or have a net positive charge which is preferably a net charge of +3. A cobalt(III) ion with six ($NH_3$) ligands has a net charge of +3. A cobalt (III) ion with five ($NH_3$) ligands and one chloro ligand has a net charge of +2. A cobalt(III) ion with two ethylenediamine(en) ligands and two ($N_3$) azide ligands has a net charge of +1. Generally, the best results have occurred where the cobalt(III) complex has a net charge of +3 and/or where the cobalt(III) complex comprises at least 3 and preferably at least 5 ammine ligands.

Generally, any concentration of the cobalt(III) complex which has heretofore been found useful in conventional photographic dye image redox amplification solutions can be used in the practice of my process. The most useful concentration of the cobalt(III) complex in the first amplification solution depends on numerous variables, and the optimum level can be determined from observing the interaction of specific photographic elements and amplification solutions. With cobalt hexammine chloride or acetate, for example, good results are obtained with about 0.2 to 20 and, preferably, about 0.4 to 10 grams of cobalt(III) complex per liter of processing solution. It is a significant and surprising feature of my invention that the density of the photographic dye image is not stoichiometrically related to the concentration of the cobalt(III) complex employed. Hence, it is apparent that a substantial concentration range of the cobalt(III) complex can be employed within the purview of the invention. Further, as will be more fully discussed below, the cobalt(III) complex need not be present in the first amplification solution as initially formulated, but can be incorporated in the photographic element being processed, if desired; hence, there is no minimum required cobalt(III) complex concentration in the first amplification solution.

In addition to the cobalt(III) complex as indicated above, the first amplification bath can contain a reducing agent which is incapable of reacting with cobalt(III) complex in the absence of the heterogeneous catalyst. Generally, any conventional silver halide developing agent can be employed as a reducing agent in the first amplification bath. In one specific, preferred form, the reducing agent can be a dye-image-generating reducing agent of any conventional type heretofore employed in cobalt(III) complex redox amplification reactions. It is specifically contemplated that the dye-image-generating reducing agents incorporated in the first amplification bath can be identical in kind and concentration to those described below for use in the second amplification bath. Specifically, it is contemplated to employ in this aspect of the present process combinations of color-developing agents and color couplers as described below in connection with the second amplification bath. It is also contemplated that the reducing agent employed in the first amplification bath can be a crossoxidizing developing agent of the type employed in the second amplification bath in combination with a color-developing agent or a redox dye-releaser. The reducing agents which react in the first amplification bath can be wholly or partially incorporated in the photographic element being processed rather than being incorporated in the first amplification bath.

Quite surprisingly, I have recognized that redox amplification using a cobalt(III) complex as described above is a means of obtaining an image pattern of catalytic cobalt(II) formed as an immobile reaction product corresponding to the heterogeneous catalyst image (which in the case of silver typically in turn conforms to an original latent image pattern formed on imagewise exposure of the photographic element). Whereas the cobalt(II) reaction product formed in conventional photographic silver image redox amplification has been viewed as a by-product of the process, I have observed quite unexpectedly that this reaction product can be generated and retained in an image pattern and can be used to catalyze a redox amplification reaction.

While the first amplification baths employed in the practice of my invention can have as one of their functions the generation of image dye, the primary purpose of the first amplification bath is to generate cobalt(II) reaction product in a pattern corresponding to the heterogeneous catalyst image pattern. I have observed that the cobalt(II) reaction products formed in performing the cobalt(III) complex redox amplification step can be retained in an image pattern by maintaining the first amplification bath alkaline; that is, at a pH above 7.0. However, at the lower alkaline pH values a portion of the cobalt(II) formed as a reaction product is not retained within the photographic element after formation. Accordingly, for applications where maximum retention of the cobalt (II) reaction product in an image pattern is desired, I prefer that the first amplification bath be maintained at a pH of at least 10. The alkaline pH ranges normally encountered in developing dye image-forming photographic elements, typically from about 10 to 13, are quite useful ranges for the first amplification bath employed in the practice by my invention. Generally, any of the activators described above for use in the photographic-developer baths can be employed in the first amplification baths of my process to adjust or control alkalinity.

While I do not wish to be bound by any particular theory to account for the preservation of the image pattern by the cobalt(II), one possible explanation is that the cobalt(II) produced as a reaction product may immediately complex with water to form an aquo-cobalt(II) complex which is both catalytic for the redox amplification reaction to follow and immobile in the amplification solutions. Where photographic elements are chosen for processing, which elements contain the photographic silver image in a hydrophilic colloid vehicle or peptizer, the cobalt(II) formed may become associated with the hydrophilic colloid ionically or physically so that its mobility is restricted. I have particularly observed that photographic silver images produced through the development of a gelatino-silver halide emulsion layer produce cobalt(II) catalysts which conform well to the original latent image pattern of the emulsion layer. It is contemplated that a combination of water and hydrophilic colloid (e.g., gelatin) interactions with imagewise-generated cobalt (II) may account for its surprising immobility in aqueous alkaline solutions in a preferred form of my invention.

In one illustrative form, the first amplification baths used in the practice of my invention can be formed merely by adding to an alkaline silver halide developer solution a cobalt(III) complex of the type and in the concentration ranges discussed above. Of course, the cobalt(III) complex need not be added to complete the first amplification bath if it is alternatively incorporated initially within the photographic element being processed. It is preferred that the first amplification baths employed in the practice of my invention contain from 0.05 through 0 molar concentration of a multidentate ligand-forming compound, as described above, more preferably from 0.01 through 0 molar concentration, so that the formation of an immobile, catalytic cobalt (II) reaction product is favored.

THE SECOND AMPLIFICATION

In one form of my invention, after forming an imagewise distribution of a catalytic cobalt(II) reaction product, I transfer the photographic element being processed to a peroxide oxidizing agent containing redox amplification bath, hereinafter designated a second amplification bath. The second amplification bath can take the form of conventional peroxide oxidizing agent containing redox amplification baths of the type disclosed in U.S. Pat. Nos. 3,674,490, 3,776,730 and 3,684,511, each cited above. The bath can also take the form of that disclosed in British Pat. No. 1,329,444 or "Image Amplification Systems", Item No. 11660 of *Research Disclosure,* both cited above. The disclosures of each of the above are herein incorporated by reference. These redox amplification baths are aqueous solutions containing a peroxide oxidizing agent.

The peroxide oxidizing agents employed in the practice of my invention can be chosen from among conventional peroxide oxidizing agents which are known to require the presence of a catalyst surface to oxidize a dye-image-generating reducing agent. Peroxide oxidizing agents of this type include water-soluble compounds containing a peroxy group are preferably employed as peroxide oxidizing agents in the practice of my invention. Inorganic peroxide compounds or salts of peracids, for example, perborates, percarbonates or persilicates and, particularly, hydrogen peroxide, can be employed as peroxide oxidizing agents in the practice of my invention as well as organic peroxide compounds such as benzoyl peroxide, percarbamide and addition compounds of hydrogen peroxide and aliphatic acid amides, polyalcohols, amines, acyl-substituted hydrazines, etc. I prefer to employ hydrogen peroxide since it is highly active and easily handled in the form of aqueous solutions. Peroxide oxidizing agent concentrations of from 0.001 mole to 0.5 mole per liter of amplification bath are preferred.

In addition to at least one peroxide oxidizing agent, the second redox amplification bath can additionally contain a dye-image-generating reducing agent which is capable of reacting with the peroxide oxidizing agent in the absence of a catalyst. The dye-image-generating reducing agent can be of any conventional type heretofore employed in redox amplification baths. In one form, the dye-image-generating reducing agent is a compound which forms a highly colored reaction product upon oxidation or which upon oxidation is capable of reacting with another compound, such as a color coupler, to form a highly colored reaction product. Where the dye-image-generating reducing agent forms a colored reaction product directly upon oxidation, it can take the form of a dye precursor such as, for example, a leuco dye or vat dye that becomes highly colored upon oxidation.

Where the dye-image-generating reducing agent is oxidized to form a highly colored reaction product with another compound, such as a color coupler, the dye-image-generating reducing agent is preferably employed in the form of a color-developing agent. Any primary aromatic amine color-developing agent can be used in the process of my invention, such as p-aminophenols, p-phenylenediamines or p-sulfonamidoaniline. Color-developing agents which can be used include 3-acetamido-4-amino-N,N-diethylaniline, 4-amino-N-ethyl-N-β-hydroxyethylaniline sulfate, N,N-diethyl-p-phenylenediamine, 2-amino-5-diethylaminotoluene, N-ethyl-N-β-methanesulfonamidoethyl-3-methyl-4-aminoaniline, 4-amino-N-ethyl-3-methyl-N-(β-sulfoethyl)aniline, 2-methoxy-4-phenylsulfonamidoaniline, 2,6-dibromo-4-aminophenol and the like. See Bent et al, JACS, Vol. 73, pp. 3100–3125 (1951); Mees and James, *The Theory of the Photographic Process,* 3rd Edition, 1966, published by MacMillan Co., New York, pp. 278–311; Villard U.S. Pat. No. 3,813,244, issued May 28, 1974; and Bush and Newmiller U.S. Pat. No. 3,791,827, issued February 12, 1974, for further typical useful developing agents. Aromatic primary amino color-developing agents which provide particularly good results in this invention are 4-amino-N,N-diethylaniline hydrochloride, 4-amino-3-methyl-N,N-diethylaniline hydrochloride, 4-amino-3-methyl-N-ethyl-N-β-(methanesulfonamide)ethylaniline sulfate hydrate, 4-amino-3-methyl-N-ethyl-N-β-hydroxyethylaniline sulfate, 4-amino-3-dimethylamino-N,N-diethylaniline sulfate hydrate, 4-amino-3-methoxy-N-ethyl-N-β-hydroxyethylaniline hydrochloride, 4-amino-3-β-(methanesulfonamide)ethyl-N,N-diethylaniline dihydrochloride and 4-amino-N-ethyl-N-(2-methoxyethyl)-m-toluidine di-p-toluene sulfonate.

A conventional silver halide black-and-white developing agent can be used in combination with color-developing agent. The black-and-white developing agent can be incorporated in the second amplification bath or the photographic element, e.g., as described in *Research Disclosure, Vol.* 108, Item 10828, published April, 1973. Upon reaction with the cobalt(III) complex oxidizing agent, oxidized black-and-white developer can, under properly chosen conditions, crossoxidize with the color-developing agent to generate oxidized color-developing agent which forms dye by reaction with color couplers.

The color couplers employed in combination with the color-developing agents include any compound which reacts (or couples) with the oxidation products of a primary aromatic amine developing agent on photographic development to form an image dye, and also any compound which provides useful image dye when reacted with oxidized primary aromatic amino developing agent such as by a coupler-release mechanism. These compounds have been variously termed "color couplers", "photographic color couplers", "dye release couplers", "dye-image-generating couplers", etc., by those skilled in the photographic arts. The photographic color couplers can be incorporated in the amplification bath or in the photographic element, e.g., as described and referred to in *Product Licensing Index, Vol.* 92, December, 1971, page 110, paragraph XXII. When they are incorporated in the element, they preferably are nondiffusible in a hydrophilic colloid binder (e.g., gelatin) useful for photographic silver halide. The couplers can form diffusible or nondiffusible dyes. Typical preferred color couplers include phenolic, 5-pyrazolone and open-chain ketomethylene couplers. Specific cyan, magenta and yellow color couplers which can be employed in the practice of this invention are described by Graham et al in U.S. Pat. No. 3,046,129 issued Jan. 24, 1962, column 15, line 45, through column 18, line 51, which disclosure is incorporated herein by reference. Such color couplers can be dispersed in any convenient manner, such as by using the solvents and the techniques described in U.S. Pat. No. 2,322,027 by Jelley et al issued June 15, 1943, or U.S. Pat. No. 2,801,171 by Fierke et al issued July 30, 1957. When coupler solvents are employed, the most useful weight ratios of color coupler to coupler solvent range from about 1:3 to 1:0.1. The useful couplers include Fischer-type incorporated couplers such as those described by Fischer in U.S. Pat. No. 1,055,155 issued Mar. 4, 1913, and particularly nondiffusible Fischer-type couplers containing branched carbon chains, e.g., those referred to in Willems et al U.S. Pat. No. 2,186,849. Particularly useful in the practice of this invention are the nondiffusible color couplers which form nondiffusible dyes.

In certain preferred embodiments, the couplers incorporated in the photographic elements being processed are water-insoluble color couplers which are incorporated in a coupler solvent which is preferably a moderately polar solvent. Typical useful solvent include tri-o-cresyl phosphate, di-n-butyl phthalate, diethyl lauramide, 2,4-di-tert-amyl-phenol, liquid dye stabilizers as described in an article entitled "Improved Photographic Dye Image Stabilizer-Solvent", *Product Licensing Index,* Vol. 82, pp. 26–29, March 1971, and the like.

In certain highly preferred embodiments, the couplers are incorporated in the photographic elements by dispersing them in a water-miscible, low-boiling solvent having a boiling point of less than 175° C and preferably less than 125° C, such as, for example, the esters formed by aliphatic alcohols and acetic or propionic acids, i.e., ethyl acetate, etc. Typical methods for incorporating the couplers in photographic elements by this technique and the appropriate solvents are disclosed in U.S. Pat. No. 2,949,360, column 2, by Julien; U.S. Pat. No. 2,801,170 by Vittum et al; and U.S.Pat. No. 2,801,171 by Fierke et al.

Color couplers can also be incorporated into the photographic elements that are useful in the practice of my invention by blending them into the photographic emulsions in the form of latexes, called "coupler-loaded" latexes. Coupler-loaded latexes are polymeric latexes into the particles of which has been blended the coupler(s). Coupler-loaded latexes can be prepared in accordance with the process of Chen, which is described in U.S. Patent Application Ser. No. 575,689, filed May 8, 1975, now abandoned. This disclosure is incorporated by reference into the present application. Briefly, this process involves (1) the dissolution of the coupler into a water-miscible organic solvent, (2) blending into the resulting solution a selected aqueous loadable latex, and (3) optionally removing the organic solvent, for example by evaporation thereof.

Instead of producing a color reaction product upon oxidation, the dye-image-generating reducing agent can be of a type which is initially colored, but which can be used to provide an imagewise distribution of image dye by alteration of its mobility upon oxidation. Image-dye-generating reducing agents of this type include dye developers of the type disclosed, for example, in Rogers U.S. Pat. No. 2,774,668 (issued Dec. 18, 1956) and U.S. Pat. No. 2,983,606 (issued May 9, 1961), here incorporated by reference. These compounds are silver halide developing agents which incorporate a dye moiety. Upon oxidation by the peroxide oxidizing agent directly or acting through a crossoxidizing auxiliary silver halide developing agent (such as described above), the dye developer alters its mobility to allow a dye image to be produced. Typically, the dye developer goes from an initially mobile to an immobile form upon oxidation in the redox amplification bath.

Other image-dye generating reducing agents which produce dye image patterns by immobilization are redox dye-releaser dye image forming compounds. The redox dye-releasers (also hereafter referred to as RDR's) are initially immobile and undergo oxidation followed, in certain instances, by hydrolysis in an aqueous alkaline environment to provide an imagewise distribution of a mobile image dye. Compounds of this type are disclosed, for example, in Whitmore et al Canadian Pat. No. 602,607 (issued Aug. 2, 1960); Fleckenstein Belgian Pat. No. 788,268 (issued Feb. 28, 1973); Fleckenstein et al published U.S. patent application Ser. No. 351,673 (published Jan. 28, 1975 as Trial Voluntary Protest No. B351,673); Gompf U.S. Pat. No. 3,698,897; Becker et al U.S. Pat. No. 3,728,113; Anderson et al U.S. Pat. No. 3,725,062; and U.S. Pat. Nos. 3,443,939; 3,443,940; 3,443,941; 3,390,380 and the like; all of which are here incorporated by reference.

Redox dye-releasers are similar to color-developing agents employed in combination with crossoxidizing developing agents in that redox dye-releasers react through an intermediate redox couple provided by a crossoxidizing silver halide developing agent. In this redox couple the silver halide developing agent reacts with the cobalt(III) oxidizing agent to form oxidized developing agent. The oxidized developing agent then reacts with the redox dye-releaser and is regenerated. The oxidized redox dye-releaser hydrolyzes in an aqueous alkaline medium to release mobile dye. The aqueous alkaline medium preferably has a pH of at least 10 and can take the form of any of the processing baths in which the peroxide oxidizing agent can be incorporated in the practice of my invention. Where the dye-image-generating agent is a redox dye-releaser, it is initially immobile and is incorporated in the photographic element to be processed, usually in a silver halide emulsion layer or in a processing solution permeable layer adjacent thereto at a concentration of from about 0.5 to 8.0 percent by weight based on the total weight of the emulsion layer. Exemplary useful crossoxidizing silver halide developing agents are disclosed in the patents relating to redox dye-releasers set forth above. Illustrative examples of preferred developing agents useful as crossoxidizing developing agents (or electron transfer agents) in practicing this invention include 1-phenyl-3-pyrazolidone, 1-phenyl-4,4-dimethyl-3-pyrazolidone and 4-hydroxymethyl-4-methyl-1-phenyl-3-pyrazolidone.

The term "nondiffusible" used herein as applied by dye-image-generating reducing agents, couplers and their reaction products has the meaning commonly applied to the term in color photography and denotes materials which for all practical purposes do not migrate nor wander through photographic hydrophilic colloid layers, such as gelatin, particularly during processing in aqueous alkaline solutions. The same meaning is attached to the term "immobile". The terms "diffisible" and "mobile" have the converse meaning.

The dye-image-generating reducing agents and color couplers, if any, can be incorporated initially entirely within the amplification bath, within the photographic element being processed or distributed between the two in any desired manner. As noted above, the dye-image-generating reducing agents can also be present in both of the amplification baths. The silver halide developing agents used as crossoxidizing agents and color-developing agents can be incorporated initially within the photographic elements (as is well understood in the art), but they are preferably incorporated within the amplification bath. For most applications, it is preferred that the color couplers by incorporated within the photographic elements being processed. Where the dye-image-generating reducing agent is of a type which provides an image by alteration in mobility, it is usually preferred that it be initially incorporated within the photographic element. The amount of dye-image-generating reducing agent incorporated within the first and second amplification baths can be varied over a wide range corresponding to the concentrations in conventional photographic developer baths. The amount of developing agent used in the second amplification bath is preferably from about 1 to 20 and, most preferably, from about 2 to 10 grams per liter, although both higher and lower concentrations can be employed. Like concentrations of color-developing agent or black-and-white developing agent used as a reducing agent, are preferred for the first amplification bath.

Since the reducing agents employed in the practice of my process have heretofore been employed in the art in silver halide developer solutions, best results can be obtained by maintaining the amplification bath within the alkaline pH ranges heretofore employed in developing photographic silver halide emulsions. Where a color-developing agent is being employed as a reducing agent, the pH of the amplification bath in which it is employed is at least 8, most preferably from 10 to 13. The first and second amplification baths are typically maintained alkaline using activators of the type described above in connection with the developing step of my process. Other addenda known to facilitate image-dye formation in alkaline photographic developer solutions with specific dye-image-generating reducing agents can also be included in the amplification baths. For example, where incorporated color couplers are employed, it may be desirable to include in the second amplification bath an aromatic solvent such as benzyl alcohol to facilitate coupling. Where lower pH alkaline amplification baths are being employed in combination with RDR-containing photographic elements, the mobility of the released dye can be enhanced by incorporating amino acids or combinations of amines and aliphatic carboxylic acids. Exemplary useful compounds include ω-amino acids, such as 2-aminoacetic acid, 4-aminobutyric acid, 6-aminohexanoic acid, 11-aminoundecanoic acid and 12-aminododecanoic acid. Such released dye solubilizers can be present in the amplification bath in concentrations of from about 0.1 to 60 grams per liter, preferably from about 1 to 20 grams per liter.

While it is essential that a cobalt(III) complex which is capable of permanently releasing its ligands upon reduction be employed in the first amplification step and that a peroxide oxidizing agent be employed in the second amplification step, it is specifically contemplated that the cobalt(III) complex can, if desired, also be incorporated in the second amplification bath to further amplify image dye generation. The cobalt(III) complex can in this instance be used in concentrations up to those employed in the first amplification bath. In still another variation, the peroxide oxidizing agent can be incorporated in the first amplification bath in a concentration up to that employed in the second amplification bath.

Where the heterogeneous catalyst takes the form of a silver image and/or the heterogeneous catalyst is present in a photographic silver halide layer of the photographic element being processed, bleaching and/or fixing agents can be coveniently incorporated in the second amplification bath. This can be accomplished in one form by employing a cobalt(III) complex such as employed in the first amplification step or of the type disclosed for example, in British Pat. No. 777,635 or my U.S. Pat. No. 3,923,511, issued Dec. 2, 1975, the disclosures of which are here incorporated by reference. Where the cobalt(III) complex is employed in combination with a compound which is capable of forming a silver salt, but which is incapable of oxidizing image silver, the cobalt(III) complex, the silver salt-forming compound and the image silver and/or silver halide interact to bleach and/or fix the photographic element being processed.

The silver salt-forming compounds employed for bleaching silver in the second amplification step, where this is desired, can take the form of a conventional silver halide solvent. Silver halide solvents are defined as compounds which, when employed in an aqueous solution (60° C), are capable of dissolving more than ten times the amount (by weight) of silver halide which can be dissolved in water at 60° C.

Typical useful silver halide solvents include water-soluble thiosulfates (e.g., sodium thiosulfate, potassium thiosulfate, ammonium thiosulfate, etc.), thiourea, ethylenethiourea, a water-soluble thiocyanate (e.g., sodium thiocyanate, potassium thiocyanate and ammonium thiocyanate), and a water-soluble sulfur-containing dibasic acid or diol. Water-soluble diols used to advantage include those having the formula: $HO(CH_2CH_2Z)_pCH_2CH_2OH$, where $p$ is an integer of from 2 to 13, and Z represents oxygen or sulfur atoms such that at least one third of the Z atoms is sulfur and there are at least two consecutive Z's in the structure of the compound which are sulfur atoms. The diols advantageously used are also included in compounds having the formula: $HO(—CH_2CH_2X—_{c-1}—(—CH_2CH_2X^1—_{d-1}(—CH_2CH_2X—_{e-1}—(CH_2CH_2X^1—_{f-1}(CH_2CH_2X—_{g-1}—CH_2CH_2OH$, wherein X and $X^1$ represent oxygen or sulfur, such that when X represents oxygen, $X^1$ represents sulfur, and when X represents sulfur, $X^1$ represents oxygen; and each of $c, d, e, f,$ and $g$ represents an integer of from 1 to 15, such that the sum of $c+d+e+f+g$ represents an integer of from 6 to 19, and such that at least one third of the total of all the X's plus all the $X^1$'s represent sulfur atoms and at least two consecutive X's and/or $X^1$'x in the structure of the compound are sulfur atoms.

Typical diols include the following:

(1) 3,6-dithia-1,8-octanediol
$HOCH_2CH_2SCH_2CH_2SCH_2CH_2OH$
(2) 3,6,9-trithia-1,11-undecanediol
$HOCH_2CH_2SCH_2CH_2SCH_2CH_2SCH_2CH_2OH$
(3) 3,6,9,12-tetrathia-1,14-tetradecanediol
$HO(CH_2CH_2S)_4CH_2CH_2OH$
(4) 9-oxo-3,6,9,12,15-tetrathia-1,17-heptadecanediol
$HO(CH_2CH_2S)_2CH_2CH_2O(CH_2CH_2S)_2CH_2CH_2OH$
(5) 9,12-dioxa-3,6,15,18-tetrathia-1,20-eicosanediol
$HO(CH_2CH_2S)_2(CH_2CH_2O)_2(CH_2CH_2S)_2(CH_2OH$
(6) 3,6-dioxa-9,12-dithia-1,14-tetradecanediol
$HO(CH_2CH_2O)_2(CH_2CH_2S)_2CH_2CH_2OH$
(7) 3,12-dioxa-6,9-dithia-1,14-tetradecanediol
$HOCH_2CH_2O(CH_2CH_2S)_2CH_2CH_2OCH_2CH_2OH$
(8) 3,18-dioxa-6,9,12,15-tetrathia-1,20-eicosanediol
$HOCH_2CH_2O(CH_2CH_2S)_4CH_2CH_2OCH_2CH_2OH$
(9) 12,18-dioxa-3,6,9,15,21,24,27-heptathia-1,29-nonacosanediol
$HO(CH_2CH_2S)_3CH_2CH_2OCH_2CH_2SCH_2CH_2O(CH_2CH_2S)_3CH_2CH_2OH$
(10) 6,9,15,18-tetrathia-3,12,21-trioxo-1,23-tricosanediol
$HOCH_2CH_2O(CH_2CH_2S)_2CH_2CH_2O(CH_2CH_2S)_2CH_2CH_2OCH_2CH_2OH$ Water-soluble sulfur-containing dibasic acids which can be used include those having the formula: $HOOCCH_2—(SCH_2CH_2)_qSCH_2COOH$, in which $q$ represents an integer of from 1 to 3 and the alkali metal and ammonium salts of said acids. Typical illustrative examples include:

(1) ethylene-bis-thioglycolic acid
$HOOCCH_2SCH_2CH_2SCH_2COOH$
(2) 3,6,9-trithiahendecane dioic acid
$HOOCCH_2(SCH_2CH_2)_2SCH_2COOH$
(3) 3,6,9,12-tetrathiatetradecanedioic acid
$HOOCCH_2(SCH_2CH_2)_3SCH_2COOH$
(4) ethylene-bis-thioglycolic acid disodium salt
(5) ethylene-bis-thioglycolic acid dipotassium salt
(6) ethylene-bis-thioglycolic acid diammonium salt
(7) 3,6,9-trithiahendecane dioic acid disodium salt
(8) 3,6,9,12-tetrathiatetradecanedioic acid disodium salt The silver halide solvent can be incorporated in the second amplification bath within conventional concentration limits, such as those disclosed, for example, in my U.S. Pat. No. 3,923,511 and British Pat. No. 777,635, both cited above. Where the silver halide solvent is being incorporated into the second amplification bath and it is desired to bleach and fix an element containing a photographic silver halide emulsion layer, optimum concentrations of the silver halide solvent in the second amplification bath can vary significantly, depending upon such factors as the thickness and composition of the emulsion layer, the pH of the bleaching solution, the temperature of processing, agitation, etc. Generally, in a preferred form of my invention, from about 0.2 to 250 grams or to the saturation limit of solubility of an ammonium or alkali metal thiosulfate are used per liter of processing solution and, most preferably, about 0.5 to 150 grams of sodium thiosulfate are employed per liter of the second amplification bath.

ALTERNATIVE PROCESSING MODES

The foregoing embodiment of my process can be characterized as a sequential mode of practicing my invention in that separate first and second amplification baths are employed. Heterogeneous catalyst image formation need not form a part of my sequential processing mode, but, where included, development is carried out in a separate developing bath before the photographic element being acted upon reaches the first amplification bath. As has been noted above, stop, fix and rinsing steps of a conventional character can be employed between the developing step and the first amplification step. It is also contemplated that additional processing steps can be undertaken between the first and second amplification steps. For example, where the first amplification bath is of low pH, it may be desirable to insure immobilization of the cobalt(II) reaction product by rinsing the photographic element in an aqueous alkaline solution having a higher pH, preferably at least 10, before introducing the photographic element into the second amplification bath. Where it is desired to view the dye image within the photographic element being processed, it is contemplated that stop, bleach, fix and rinse steps of a conventional nature can be practiced after removing the photographic element from the first or, preferably, the second amplification bath. In the preferred form of my process, of course, subsequent bleaching and fixing is unnecessary, since this is accomplished concurrently with the second amplification step. Where the dye image is not readily viewable in the photographic element, as where the dye within the image pattern is differentiated from background dye primarily by mobility, a separate step of transferring the image-dye pattern to a receiver sheet, as in conventional image transfer, is contemplated. In addition, or as an alternative, a retained immobile dye image pattern can be viewed in the photographic element after mobile dye has been transferred from or washed from the photographic element.

The formation of photographic dye images through the use of a peroxide redox amplification reaction in the sequential mode of practicing my process is particularly surprising. Whereas it is known in the art to employ a photographic silver image to catalyze an amplification reaction between a peroxide oxidizing agent and a dye-image-generating reducing agent, in the sequential mode it is to be noted that the silver image can be entirely bleached or poisoned as a peroxide catalyst before the photographic element being processed ever reaches the second amplification bath. It is surprising that image amplification nevertheless occurs in the second amplification bath. This sequential mode of practicing my process illustrates that a new catalyst is formed in the first amplification bath, namely, the cobalt(II) reaction product, which is retained in the original catalyst image pattern and which catalyzes the second amplification reaction. The sequential mode of practicing my process thus clearly illustrates certain novel aspects of my process.

In another mode of practicing my process, hereinafter referred to as a combined amplification mode, the first and second amplification steps can be accomplished in a single amplification bath. In a simple form, this can be accomplished merely by adding one or more peroxide oxidizing agents of the type and in the concentrations described above to one of the first amplification baths described above. Since the dye-image-generating reducing agent and the cobalt(III) complex can be incorporated initially in at least some forms within the element bearing the photographic heterogeneous catalyst image, the only essential feature of the combined amplification bath is an aqueous alkaline solution containing the peroxide oxidizing agent. However, it is preferred that at least the cobalt(III) complex and the peroxide oxidizing agent both be present in the combined amplification bath.

In a specific preferred form, the combined amplification bath is comprised of an aqueous alkaline solution having a pH of at least 8, preferably in the range of from 10 to 13, with the activators described above being relied upon to adjust and control alkalinity. In addition, the combined amplification bath contains at least one peroxide oxidizing agent and cobalt(III) complex which permanently releases ligands upon reduction. The dye-image-generating releasing agent can be present in either the photographic element or the combined amplification bath. In one specifically contemplated form, the combined amplification bath can be employed where the heterogeneous catalyst image may have been previously poisoned as a peroxide redox amplification catalyst as by contact with a bromide ion-containing developer solution, so that it is ineffective as a catalyst for the redox reaction of the peroxide oxidizing agent and the dye-image-generating reducing agent. It is specifically contempated that one or more color couplers can be present in the combined amplification bath, although they are preferably incorporated, when used, in the photographic element being processed.

In the combined amplification mode of practicing my process, it is preferred that the concentration of compounds which will form multidentate ligands when complexed with cobalt be limited to from a 0.05 through 0 molar, preferably from a 0.01 through 0 molar, concentration in the combined amplification bath. Further, so that amplification by the cobalt(III) complex rather than bleaching is favored, where the heterogeneous catalyst is a silver image, it is preferred that the silver salt-forming compounds described above as useful in achieving bleaching in the second amplification bath, be omitted from the combined amplification bath or limited to concentration levels below those described above as being effective levels for achieving bleaching.

The combined amplification mode of practicing my process using a combined amplification bath retains the effectiveness of image-dye formation observed in the sequential mode, while concurrently simplifying my process from a manipulative viewpoint and permitting an incremental increase in dye-image generation. That the same mechanisms for dye-image generation are available in the combined mode as in the sequential mode is borne out, for example, by amplification being obtained even where the silver image is poisoned as a peroxide oxidizing agent redox catalyst. In addition to the dye-generating reactions available in the sequential mode, other chemical mechanisms for dye-image generation can also be at work.

Where the heterogeneous catalyst image is a photographic silver image contained in the element to be processed and is formed from a latent image in a silver halide emulsion layer, my invention can be practiced in still another mode, hereinafter referred to as a combined development-amplification mode. In the combined development-amplification mode of practicing my invention, the steps of silver halide development and first and second amplification are accomplished in a single bath, hereinafter referred to as a development-amplification bath. Where at least one of the developing agents included within one of the developer baths employed in the sequential mode of practicing my process is also a dye-image-generating reducing agent, e.g., a color-developing agent, a development-amplification bath useful in the practice of my process can be formed merely by adding to the photographic developer bath (which containing a concentration of silver salt-forming compounds below that required to form silver image bleaching, as noted above) a cobalt(III) complex which permanently releases ligands upon reduction and a peroxide oxidizing agent, of the type and in the concentrations described above in connection with the sequential mode of practicing my process. In the combined development-amplification bath mode of practicing my invention, it is preferred that the concentration of compounds which will form multidentate ligands when complexed with cobalt be limited to form a 0.05 through 0 molar, preferably from a 0.01 through 0 molar, concentration. Where the dye-image-generating reducing agent is not a color-developing agent, a combined development-amplification bath useful in the practice of my invention can be formed merely by adding a developing agent to the combined amplification bath disclosed above in the combined amplification mode of practicing my process. Where a combined amplification bath contains a color-developing agent already as a dye-image-generating reducing agent, it can be employed without adding additional ingredients to process an element containing a photographic silver halide emulsion layer bearing a latent image according to the combined development-amplification bath mode of practicing my invention.

In a specific preferred form, the combined development-amplification bath employed in the practice of my process is comprised of an aqueous alkaline solution having a pH of at least 8, and preferably in the range of from 10 to 13, where the activators described above are relied upon to adjust and control alkalinity. In addition, the combined development-amplification bath contains at least one peroxide oxidizing agent. A dye-image-generating reducing agent can be incorporated within the combined development-amplification bath or within the photographic element. In a specific preferred form, the dye-image-generating reducing agent takes the form of a color-developing agent, such as a primary aromatic amine color-developing agent, incorporated within the combined development-amplification bath and used in combination with a color coupler incorporated within the photographic element being processed. At least one cobalt(III) complex which permanently releases ligands upon reduction is incorporated either within the combined development-amplification bath or the photographic element being processed. Other conventional photographic silver halide developer addenda, such as those disclosed above in describing the developer composition, can also be included in the combined development-amplification bath. Where the dye-image-generating reducing agent takes the form of a redox dye-releaser it is essential that the bath incorporate a cross-oxidizing developing agent, which can be, or be in addition to, the silver halide developing agent. Where the dye-image-generating reducing agent is a color-developing agent, it is preferred to employ a crossoxidizing developing agent in combination therewith. The crossoxidizing developing agent most preferably takes the form of a conventional black-and-white developing agent, such as pyrazolidone, polyhydroxybenzene (e.g., hydroquinone), pyrimidine, hydrazine or similar developing agent. The black-and-white developing agent can be incorporated in the photographic element or in the combined development-amplification bath.

The combined development-amplification bath mode of practicing my process retains the effectiveness of image-dye formation observed in the sequential and combined amplification modes of practicing my invention. It is believed that substantially the same reactions account for image-dye formation in the combined development-amplification bath mode as in the sequential and combined amplification modes. Thus, the combined development-amplification bath mode of practicing my invention offers the advantages of requiring few manipulative steps while allowing an enhanced dye image to be produced. My process of forming dye images employing a combined development-amplification bath is, for example, capable of producing a denser dye image in a given time period than can be produced using previously taught processing relying on a cobalt(III) complex for redox amplification and lacking a peroxide oxidizing agent. Further, my process offers a distinct advantage in that image silver is not required to support the peroxide redox amplification reaction. Thus, my process can be practiced where the silver image is in a form which is noncatalytic for the peroxide redox reaction. In this form, it is the immobile cobalt(II) reaction product that is the catalyst for the redox amplification reaction involving the dye-image-generating reducing agent and the peroxide oxidizing agent.

In still another mode of practicing my process, hereafter referred to as a combined development-first amplification mode, the silver halide development and cobalt(III) complex redox amplification steps are performed in a single bath, and the second amplification step, or peroxide redox amplification step, is performed thereafter as described in the sequential mode of practicing my process. The combined development-first amplification processing solution can be identical to that of the processing solution employed in the combined development-amplification mode, described above, except that the peroxide oxidizing agent is omitted.

Where a dye image has been formed by any one of the three modes of my process described above and it is thereafter desired to remove or reduce the density of the heterogeneous catalyst image, this can be accomplished by conventional means. For example, where the heterogeneous catalyst image is a silver image, it can be removed by using a conventional bleaching agent. Where the photographic element being processed is a silver halide photographic element it can be bleached and/or fixed by any convenient conventional approach. It is, of course, recognized that sufficient amplification is possible using my process so that the density of the original heterogeneous catalyst image can be inconsequential compared to the density of the dye image, so that no bleaching of the heterogeneous catalyst image is required.

In the foregoing description of my process it is apparent that oxidizing agents, the peroxide oxidizing agents and the cobalt(III) complexes, the reducing agents, the silver halide developing agents and the dye-image-generating reducing agents, will be brought into contact. Where these oxidizing and reducing agents are brought into contact, they must be essentially inert to oxidation-reduction in the absence of a catalyst, specifically, the cobalt(II) reaction product or the developed silver image. By "essentially inert to oxidation-reduction reaction in the absence of a catalyst" it is meant simply that the oxidizing agent and reducing agent combinations must be at least as unreactive in the absence of a catalyst as those combinations of these oxidizing and reducing agents which have been employed in conventional redox amplification systems of the type disclosed, for example, in U.S. Pat. Nos. 3,765,891; 3,822,129; 3,834,907; 3,847,619; 3,862,843; 3,923,511; 3,902,905; 3,674,490; 3,674,490; 3,694,207; 3,765,890; 3,776,730; 3,817,761; and 3,684,511. In the combined development-amplification mode of practicing my process all of the above oxidizing and reducing agents can be in a single bath or the photographic element immersed therein so that they are in contact. However, in the sequential mode of practicing my process only the cobalt(III) complex and reducing agent in the first amplification bath and the peroxide oxidizing agent and the dye-image-generating reducing agent in the second amplification bath need be in contact, as among the above oxidizing and reducing agents. In this instance it is immaterial if the cobalt(III) complex, for example, which is in the first amplification bath, will spontaneously react with a dye-image-generating reducing agent or silver halide developing agent, which are confined to one or more separate baths. Stated, more generally, it is apparent that the above oxidizing and reducing agents which are brought into contact must be essentially inert to oxidation-reduction in the absence of a catalyst, but where the materials are not brought into contact, no such restriction on the selection of oxidizing and reducing agents is necessary.

For purposes of clarity I have described my invention in terms of four distinct processing modes; however, these modes can be hybridized so that a particular process can partake of the features of three or more of the above process modes. For example, in the sequential mode, of a cobalt(III) complex is added to the second amplification bath, further cobalt redox amplification may occur in the second amplification bath. Similarly, adding a peroxide oxidizing agent to the first amplification bath can allow a peroxide redox amplification to occur. Additionally, if a developing agent is added to one or both of the amplification baths, additional development may occur in these baths even though development is primarily conducted in a prior developer bath. From the foregoing, it is apparent that the development and amplification steps can be performed to varying degrees in the processing baths and that the reliance primarily upon a single bath as a development or amplification bath does not foreclose this step from being performed also to a lesser degree in other processing baths.

THE ELEMENT

The photographic elements processed according to my invention can take a variety of conventional forms. In a simple form, the photographic element to be processed can be comprised of a conventional photographic support, such as disclosed in *Product Licensing Index,* Vol. 92, December, 1971, publication 9232, paragraph X, bearing a photographic silver image. In those forms of my process which do not include the step of developing the photographic silver image, the method or approach for producing the photographic silver image is immaterial to the practice of my invention and any conventional photographic silver image can be employed.

In a preferred form of my invention, the photographic elements to be processed are comprised of at least one photographic silver halide emulsion layer which either bears the photographic silver image or is capable of forming a photographic silver image. I specifically contemplate the processing of photographic elements containing at least one photographic silver halide emulsion layer which upon image-wise exposure to actinic radiation (e.g., ultraviolet, visible, infrared, gamma or X-ray electromagnetic radiation, electron-beam radiation, neutron radiation, etc.) is capable of forming a developable latent image. The silver halide emulsions employed to form useful emulsion layers include those disclosed in *Product Licensing Index,* publication 9232, cited above, paragraph I, and these emulsions can be prepared, coated and/or modified as disclosed in paragraphs II through VIII, XII, XIV through XVIII and XXI.

While the photographic elements employed in the practice of my process employ a silver image formed from a photographic silver halide emulsion as a preferred heterogeneous catalyst, it is appreciated that any of the heterogeneous catalysts noted above in the description of my process can be incorporated in the photographic elements in place of or in combination with silver halide and/or image silver. For example, suitable heterogeneous catalyst images can be formed in the photographic element to be processed by the photoreduction of a metal salt, such as a palladium salt (e.g., palladium oxalate to metallic palladium) or a gold salt (e.g., gold halide to metallic gold). Alternatively, photo-oxidation can be employed (e.g., metallic silver to $Ag^+$). Various other techniques of forming a heterogeneous catalyst image and the photographic elements bearing such images are disclosed in my U.S. Pat. No. 3,862,842, previously cited and incorporated by reference.

The photographic elements to be processed according to my process can, of course, incorporate a cobalt(III) complex, a color coupler and/or one or more developing agents, if desired, as indicated above in the discussion of my process. The cobalt(III) complexes when incorporated in the photographic elements to be processed are preferably present as water-insoluble ion-pairs. The use of water-insoluble ion-pairs of cobalt(III) complexes is described more fully by Bissonette et al in U.S. Pat. No. 3,847,619, cited and incorporated by reference above. Generally, these ion-pairs comprise a cobalt(III) ion complex ion-paired with an anionic organic acid having an equivalent weight of at least 70 based on acid groups. Preferably, the acid groups are sulfonic acid groups. The photographic elements generally contain at least 0.1 mg/dm$^2$ of cobalt in each silver halide emulsion layer unit, and preferably from 0.2 to 5.0 mg/dm$^2$. The term "layer unit" refers to one or more layers intended to form a dye image. In a multicolor photographic element containing three separate image dye-providing layer units, the element contains at least 0.3 mg/dm$^2$ (0.1 mg/dm$^2$ per layer unit) and preferably 0.6 to 15.0 mg/dm$^2$ of cobalt in the form cobalt(III) ion complex ion-paired with an anionic organic acid.

In one specific preferred form, the photographic elements to be employed in the practice of my process can comprise a support having thereon at least one image dye-providing layer unit containing a light-sensitive silver salt, preferably silver halide, having associated therewith a stoichiometric excess of coupler of at least 40% and preferably at least 70%. The equivalency of color couplers in known in the art; for example, a 4-equivalent coupler requires 4 moles of oxidized color developer, which in turn requires development of 4 moles of silver, to produce 1 mole of dye. Thus, for a stoichiometric reacton with silver halide, 1-equivalent weight of this coupler will be 0.25 mole. In accordance with this invention, the color image-providing unit comprises at least a 40% excess of the equivalent weight of image dye-providing color coupler required to react on a stoichiometric basis with the developable silver and preferably a 70% excess of said coupler. In one highly preferred embodiment, at least a 110% excess of the coupler is present in said dye image-providing layers based on silver. The ratio can also be defined as an equivalent excess with a coupler-to-silver ratio of at least 1.4:1, and preferably at least 1.7:1 (i.e., 2:1 being a 100% excess). In certain preferred embodiments, the photographic color couplers are employed in the image dye-providing layer units at a concentration of at least 3 times, such as from 3 to 20 times, the weight of the silver in the silver halide emulsion, and the silver is present in said emulsion layer at up to 30 mg silver/ft$^2$ (325 mg/m$^2$). Weight ratios of coupler-to-silver coverage which are particularly useful are from 4 to 15 parts by weight coupler to 1 part by weight silver. Advantageously, the coupler is present in an amount sufficient to give a maximum dye density in the fully processed element of at least 1.7 and preferably at least 2.0. Preferably, the difference between the maximum density and the minimum density in the fully processed element (which can comprise unbleached silver) is at least 0.6 and preferably at least 1.0.

The light-sensitive silver salt layers used in elements processed in accordance with this invention are most preferably at silver coverages of up to about 30 mg silver/ft$^2$ (325 mg/m$^2$), such as from 0.1 to 30 mg/ft$^2$ (1.0–325 mg/m$^2$) and more preferably from about 1 to 25 mg silver/ft$^2$ (10–270 mg/m$^2$). Especially good results are obtained with coverages on the order of from about 2 to 15 mg/ft$^2$ of silver (20–160 mg/m$^2$) for the green- and red-sensitive layers in typical multilayer color films.

It is realized that the density of the dye may vary with the developing agent combined with the respective coupler, and accordingly the quantity of coupler can be adjusted to provide the desired dye density. Preferably, each layer unit contains at least $1 \times 10^{-6}$ moles/dm$^2$ of color coupler when color couplers are employed.

Advantageously, the photographic color couplers utilized are selected so that they will give a good neutral dye image. Preferably, the cyan dye formed has its major visible light absorption between about 600 and 700 nm (that is, in the red third of the visible spectrum), the magenta dye has its major absorption between about 500 and 600 nm (that is, in the green third of the visible spectrum), and the yellow dye has its major absorption between about 400 and 500 nm (that is, in the blue third of the visible spectrum). Particularly useful elements comprise a support having coated thereon red-, green- and blue-sensitive silver halide emulsion layers containing, respectively, cyan, magenta and yellow photographic color couplers.

The light-sensitive silver salts are generally coated in the color-providing layer units in the same layer with the photographic color coupler. However, they can be coated in separate adjacent layers as long as the coupler is effectively associated with the respective silver halide emulsion layer to provide for immediate dye-providing reactions to take place before substantial color-developer oxidation reaction products diffuse into adjacent color-providing layer units.

Where an initially immobile dye-image-generating reducing agent is employed, it is initially present within the photographic element. Redox dye-releasers (RDR's) constitute a peferred class of initially immobile dye-image-generating reducing agents. Suitable redox dye-releaser containing photographic elements useful in the practice of my process can be formed by substituting RDR's for the incorporated color couplers in the photographic elements described above. In a multilayer photographic element intended to form a multicolor image one or more RDR's capable of releasing a yellow dye are incorporated in the blue recording emulsion layer or in a separate processing solution permeable layer adjacent thereto at a concentration of from about 0.5 to 8 percent by weight based on the total weight of the blue recording emulsion layer. The layer adjacent the emulsion layer is typically a hydrophilic colloid layer, such as a gelatin layer. In a similar manner one or more RDR's are also associated with the green and red recording emulsion layers capable of releasing magenta and cyan dyes, respectively. Single color, single RDR-containing photographic elements are, of course, useful as well as multicolor elements.

Exemplary of specifically preferred RDR's are those of the sulfonamide type, which may be represented by the following general formula:

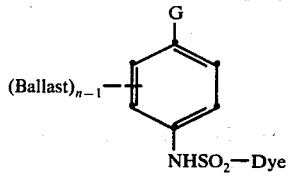

(I)

wherein:

(1) Dye is a dye or dye precursor moiety;

(2) Ballast in an organic ballasting radical of such molecular size and configuration (e.g., simple organic groups or polymeric groups) as to render the compound nondiffusible during development in an alkaline processing composition;

(3) G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when R$_1$ is an alkyl group of a greater than 6 carbon atoms, it can serve as a partial or sole Ballast group); and (4) *n* is a positive integer of 1 to 2 and is 2 when G is OR or when R$_1$ is hydrogen or an alkyl group of less than 8 carbon atoms.

In addition to Ballast, the benzene nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

Exemplary hydroquinone-type RDR's which can be used according to this invention are represented by the following formula:

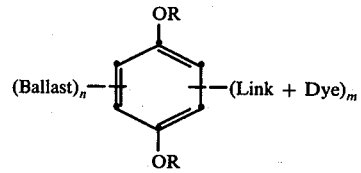

(II)

wherein:

(1) each R represents hydrogen or a hydrolyzable moiety;

(2) Ballast is a photographically inert organic ballasting radical of such molecular size and configuration as to render the alkali-cleavable compound nondiffusible during development in an alkaline processing composition;

(3) Dye is a dye or dye precursor;

(4) Link is a S, O, or $SO_2$ linking group;

(5) *n* is an integer of 1 and 3; and (6) *m* is an integer of 1 to 3.

The nature of the ballast group (Ballast) in the formula for the compounds described above is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

As previously mentioned, Dye in the above formula represents a dye or dye precursor moiety. Such moieties are well known to those skilled in the art and include dyes such as azo, azomethine, azopyrazolone, indoaniline, indophenol, anthraquinone, triarylmethane, alizarin, metal complexed dyes, etc., and dye precursors such as a leuco dye, a "shifted" dye which shifts hypsochromically or bathochromically when subjected to a different environment such as a change in pH, reaction with a material to form a complex, etc. Dye could also be a coupler moiety such as a phenol, naphthol, indazolone, open-chain acetanilide, pivalylacetanilide, malonamide, malonanilide, cyanoacetyl, coumarone, pyrazolone, compounds described in U.S. Pat. No. 2,765,142, etc. These compounds may contain a solubilizing group if desired. Examples of such dye groups include the following:

YELLOW DYE GROUPS

YDG-1 4-Hydroxy azophenylphenylene

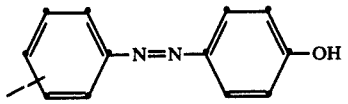

YDG-2 3-Methyl-4-hydroxyazophenylphenylene

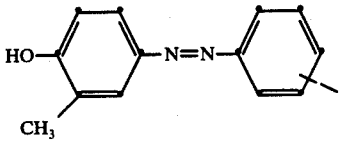

YDG-3

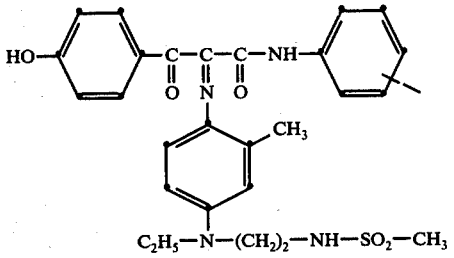

YDG-4 p-Sulfhydrylazophenylphenylene

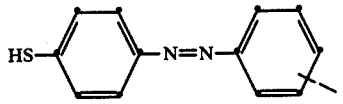

YDG-5

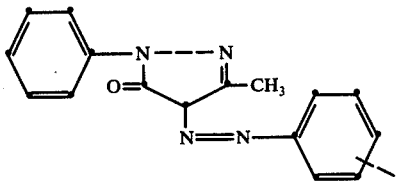

YDG-6

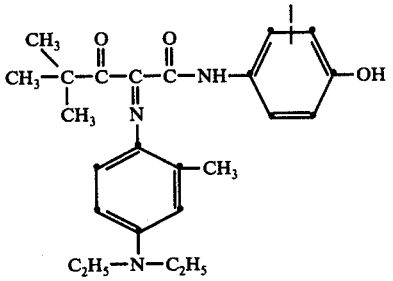

-continued

YDG-7

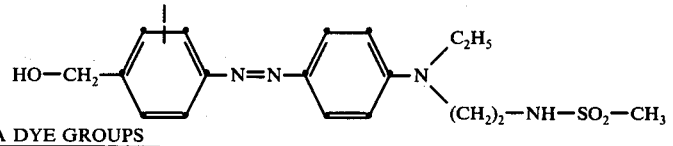

MAGENTA DYE GROUPS

MDG-1

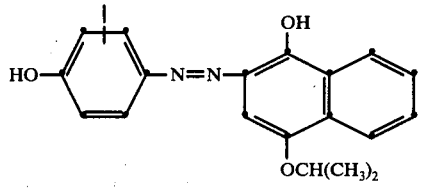

MDG-2

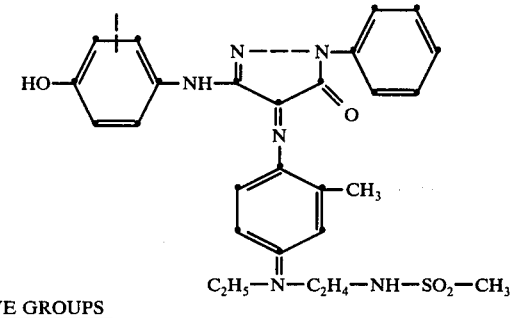

CYAN DYE GROUPS

CDG-1

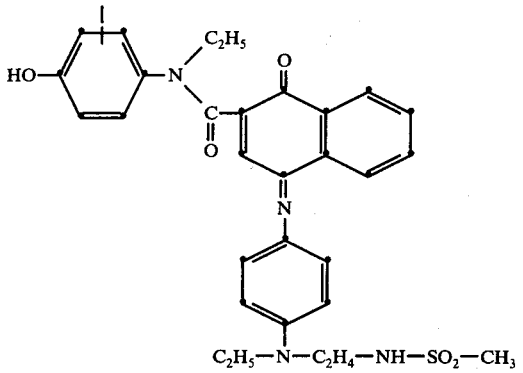

CDG-2

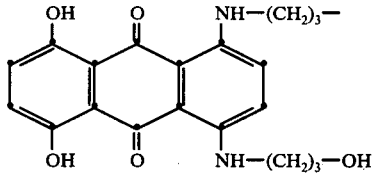

When dye precursor moieties are employed in the RDR's instead of dyes, they are converted to dyes by means well known to those skilled in the art, e.g., oxidation, either in the photosensitive element, in a processing composition or in a dye image-receiving layer to form a visible dye. Such techniques are disclosed, for example, in British Pat. Nos. 1,157,501; 1,157,502; 1,157,503; 1,157,504; 1,157,506; 1,157,507; 1,157,508; 1,157,509; 1,157,510; and U.S. Pat. Nos. 2,774,668; 2,698,798; 2,698,244; 2,661,293; 2,559,643; etc.

My process can be practiced with photographic elements of the color diffusion transfer type. In a simple application of my invention, a combined development-amplification bath according to my invention can be substituted for the processing composition employed in a conventional color image transfer element. It is specifically contemplated that my process can be practiced with either "peel-apart" or integral color diffusion transfer photographic elements. The sequential and combined modes of practicing my invention can be readily employed wiht peel-apart-type color image transfer elements. In most instances, where successive processing compositions are to be brought into contact with the photographic element, a receiver element capable of receiving and mordanting a transferred dye image can be brought into contact with the photographic element after amplification is complete. Typical color image transfer elements useful in conjunction with my process include Rogers U.S. Pat. Nos. 2,774,668 and 2,983,606, cited above; Weyerts U.S. Pat. No. 3,146,102 (issued Aug. 25, 1974; Barr et al U.S. Pat. Nos. 3,227,551 and 3,227,554 (issued Jan. 4, 1966); Whitmore et al U.S. Pat. No. 2,337,550 (issued Jan. 4, 1966); Whitmore U.S. Pat. No. 3,227,552 (issued Aug. 27, 1964); Land U.S. Pat. Nos. 3,415,644, 3,415,645 and 3,415,646 (issued Oct. 16, 1973); as well as Canadian Pat. No. 602,607, U.S. Ser. No. B351,673; Belgian Pat. No. 788,268; and U.S. Pat. Nos. 3,698,897; 3,728,113, 3,725,062; 3,443,939; 3,443,940; and 3,443,941, each cited above.

Where my process is applied to color diffusion transfer type elements and processes, it is appreciated that the dye image which is produced may not be visually discernable within the layer in which it is formed, since it may not chromophorically differ from other layer components, but may differ in terms of relative mobility. The dye image of alterred mobility can be employed to form a visible image by selectively transferring either the dye image or the chromophorically similar layer component to a receiver for viewing. As is well understood in the color diffusion transfer imaging, conventional chromophoric layer components can be initially mobile and immobilized when oxidized or initially immobile and rendered mobile by oxidation. In addition to color developing agents and color couplers which form dyes upon reaction, chromophoric components wherein the chromophoric unit is preformed, such as dye developers and redox dye-releasers, have been widely used in color diffusion transfer imaging. The preferred chromophoric components for use in a color diffusion transfer method according to my invention are redox dye-releasers which are initially immobile and which are rendered sufficiently mobile for diffusion transfer to a receiver for viewing upon reaction with an oxidized silver halide developing agent followed, in some instances, by alkaline hydrolysis.

The photographic element employed in the practice of my process can, if desired, initially contain one or more compounds capable of forming multidentate ligands with cobalt. The presence of such compounds in the photograhic element during development can enhance maximum dye image densities, as described above. Such compounds can be leached or otherwise removed from the photographic element prior to the first amplification step, so that the preferred low levels of multidentate ligand-forming compounds are present during that step. I prefer that the photographic elements initially contain low levels or no multidentate ligand-forming compounds, particularly where the photographic element is to be employed in the monobath mode of practicing my invention; however, any alternative approach which insures the desired low concentrations of multidentate ligand-forming compounds during the first amplification step can be advantageously employed.

EXAMPLES

The practice of my invention can be better appreciated by reference to the following examples:

EXAMPLE 1 - A COMBINED DEVELOPMENT-AMPLIFICATION MODE

A. A photographic element having a film support and a gelatino-silver halide emulsion layer coated thereon was prepared. The emulsion coating contained the ingredients set forth below in Table 1. Unless otherwise stated, all coating densities in the examples are reported parenthetically in terms of mg/0.093 meter$^2$ (i.e., mg/ft$^2$). Silver halide coating densities are reported in terms of silver. Unless otherwise stated, all processing was conducted at 24° C.

Table 1

| Photographic Element 1-A |
|---|
| Gelatino-Silver Halide Emulsion Layer: Silver Halide (10); Gelatin (300); Coupler Solvent Di-n-butyl phthalate (62.5); Coupler 2-[α-(2,4-Di-tert-amylphenoxy)butyramido]-4,6-dichloro-5-methylphenol (125) |
| Transparent Cellulose Triacetate Film Support |

The silver halide employed was a sulfur and gold chemically sensitized cubic grain silver bromide having a mean grain size of 0.8 micron.

B. A first sample of the photographic element was exposed with a white light source through a graduated-density test object having 21 equal density steps ranging from 0 density at Step 1 to a density of 6.0 at Step 21. The exposed sample was then developed for 4 minutes in a color developer solution of the composition set forth below in Table 2.

Table 2

| Color Developer | |
|---|---|
| $Na_2SO_3$ | 2.0 g |
| color-developing agent, 4-Amino-3-methyl-N-ethyl-N-β-(methanesulfonamido)ethylaniline sulfate hydrate (CDA-1) | 5.0 g |
| $Na_2CO_3$ | 20.0 g |
| KBr | 0.025 g |
| Water to 1 liter (pH 10.3) | |

The sample was immersed for one minute in a dilute acetic acid stop bath, washed for one minute in water, and then immersed for 2 minutes in a bleach solution of the composition set forth in Table 3.

Table 3

| Bleach | |
|---|---|
| $Na_3[Fe(CN)_6] \cdot 10H_2O$ | 240.0 g |
| $K_2S_2O_8$ | 67.0 g |
| Polyethylene glycol | 3.0 g |
| NaOH | 0.1 g |
| Borax | 1.0 g |
| NaBr | 35.0 g |
| Water to 1 liter (pH 8.2) | |

The sample was then washed for one minute in water, immersed for 2 minutes in a fix bath of the composition set forth in Table 4, washed in water again for one minute and then allowed to dry.

Table 4

| Fix Bath | |
|---|---|
| $Na_2S_2O_3$ | 240.0 g |
| $Na_2SO_3$ | 15.0 g |
| $H_3BO_3$ (crystals) | 7.5 g |
| Potassium alum | 15.0 g |
| $H_2O$ to make 1 liter | |

The processed sample contained a dye image attributable entirely to the reaction of the color developing agent and the color coupler. No redox amplification occurred, since no oxidizing agent for this reaction was present. The results are shown graphically in FIG. 1 as curve 1. It is believed that dye formation resulting in curve 1 can be accounted for by the following reactions:

$$\text{COL-DEV} + \text{AgX}\cdot \rightarrow \text{Ag}^\circ + \text{COL-DEV}_{ox} \quad \text{(a)}$$

$$\text{COL-DEV}_{ox} + \text{Coupler} \rightarrow \text{IMAGE DYE (DYE 1 of Eq. 5)}$$

C. A second sample identical to that of paragraph 1-B was similarly exposed, processed and examined as in paragraph 1-B, but with the exception that 2.0 grams per liter of cobalt hexammine acetate was added to the developer composition of Table 2. An amplified dye image was obtained, as is shown by curve 2 in FIG. 1. The increment of dye density over and above that obtained in the first sample is attributable to the redox amplification produced by the cobalt hexammine acetate oxidizing agent. It is believed that dye formation resulting in curve 2 can be accounted for by reactions (a) and (b) above in combination with reactions (c) and (d) below.

$$[Co(NH_3)_6]^{+3} + \text{COL-DEV} \rightarrow \text{Co(II)RP} + \text{COL-DEV}_{ox} \quad (c)$$

$$\text{COL-DEV}_{ox} + \text{Coupler} \rightarrow \text{IMAGE DYE (DYE-2 of Eq. 6)} \quad (d)$$

D. A third sample identical to that of paragraph 1-B was similarly exposed, processed and examined as in paragraph 1-B, but with the exception that 5.0 ml per liter of 30 percent by weight hydrogen peroxide in water was added to the color developer solution. An amplified dye image was obtained, as is shown by curve 3 in FIG. 1. The increment of dye density over and above that obtained in the first sample is attributable to the redox amplification produced by the hydrogen peroxide oxidizing agent. It is believed that dye formation resulting in curve 3 can be accounted for by reactions (a) and (b) above in combination with reactions (e) and (f) below.

$$H_2O_2 + \text{COL-DEV} \rightarrow \text{COL-DEV}_{ox} \quad (e)$$

$$\text{COL-DEV}_{ox} + \text{Coupler} \rightarrow \text{IMAGE DYE (DYE-3 of Eq. 7)} \quad (f)$$

E. A fourth sample identical to that of paragraph 1-B was similarly exposed, processed and examined as in paragraph 1-B, but with the exception that 5.0 ml per liter of 30 percent by weight hydrogen peroxide in water was added to the color developer solution, as in paragraph 1-D above, and 2.0 grams per liter of cobalt hexammine acetate was added to the color developer solution, as in paragraph 1-C above.

A further increase in dye image density was observed. It was expected that the dye density obtained would be the additional result of (1) the dye image density produced by the color developing agent as indicated by equations (a) and (b) above, (2) the increment in dye image density produced by incorporation of the cobalt hexammine oxidizing agent, as indicated by equations (c) and (d) above, and (3) the increment in dye image density produced by the incorporation of the hydrogen peroxide oxidizing agent, as indicated by equations (e) and (f) above. The expected dye image density, then, is indicated by curve 4.

In actual observation a dramatic further increase in dye image density was obtained, as shown by curve 5 in FIG. 1. It is not believed that this further increment in dye image density can be accounted for by equations (a), (b), (c), (d), (e) and (f). Rather, it is believed that the actually observed dye image density is the product of equations (a) through (f) and, additionally, the following reactions:

$$\text{Co(II)RP} + H_2O_2 \rightarrow \text{Co(III)OA} \quad (g)$$

$$\text{Co(III)OA} + \text{COL-DEV} \rightarrow \text{COL-DEV}_{ox} + \text{Co(II)RP} \quad (h)$$

$$\text{COL-DEV}_{ox} + \text{Coupler} \rightarrow \text{IMAGE DYE (DYE-4 of Eq. 8)} \quad (i)$$

EXAMPLE 2 - A COMBINED DEVELOPMENT-AMPLIFICATION MODE—THE EFFECT OF LENGTHENED DEVELOPMENT

Example 1 was repeated in its entirety, except that the development time was extented from 4 minutes to 8 minutes. The maximum dye image density obtained using the developing agent along, without the redox amplification oxidizing agents, was 0.8, which is about the same value as obtained in Example 1. Using the cobalt hexammine acetate in combination produced a maximum dye image density of about 1.4 as compared with 1.1 in Example 1. Using the hydrogen peroxide in combination produced a maximum dye image density of about 1.9 as compared with about 1.38 in Example 1. Using the hydrogen peroxide and the cobalt hexammine together in combination with the color developing agent produced a dye image density at Step 9 of 3.4, compared to an expected cumulative dye image density of 1.66. At all the lower numbered steps the density of the dye image was too high to be measured, whereas a maximum dye image density of 2.5 would have been predicted. This showed a very dramatic and entirely unexpected increase in dye image density.

EXAMPLE 3 - A COMBINED DEVELOPMENT-AMPLIFICATION MODE—THE EFFECT OF GRAIN SIZE

Example 1 was repeated in its entirety, except that the silver halide emulsion differed solely by having a mean grain diameter of 0.21 micron. As would be expected the finer grain emulsion showed a somewhat slower speed, however, higher maximum dye image densities were obtained in each instance. The maximum dye image density obtained using the developing agent alone, without the redox amplification oxidizing agents, was about 1.6, compared to 0.8 in Example 1. Using the cobalt hexammine acetate in combination produced a maximum dye image density of about 1.76 as compared with 1.1 in Example 1. Using the hydrogen peroxide in combination produced a maximum dye image density of about 2.5 as compared with 1.38 in Example 1. Using the hydrogen peroxide and the cobalt hexammine together in combination with the color developing agent produced a dye image density at Step 4 of 3.7, compared to an expected cumulative dye image density of 2.7. At all the lower numbered steps the density of the dye image was too high to be measured, whereas a maximum dye image density of 3.0 would have been predicted. This showed a very dramatic and entirely unexpected increase in dye image density. It showed that while more exposure is required to reach maximum dye densities using finer grain emulsions, still higher maximum densities are obtainable and that the unexpected increase in dye image density is further enhanced.

EXAMPLE 4 - A COMBINED BLACK-AND-WHITE DEVELOPMENT— FIRST AMPLIFICATION MODE

A. A photographic element having a paper support and capable of forming multicolor images was formed by coating gelatino-silver halide emulsion layers set forth below in Table 5. The silver halide was silver chlorobromide. Mean grain diameters ranged from 0.2 to 0.8 micron in the layers.

Table 5

| Photographic Element 4-A |
|---|
| Gelatin (100) |
| Red-Sensitive Layer: Red-Sensitized Silver Halide (6); Gelatin (90); Coupler Solvent Di-n-butyl phthalate (17.5); Coupler 2-[α-(2,4-Di-tert-amylphenoxy)butyramido]-4,6-dichloro-5-methyl-phenol (35) |
| Gelatin (160); 3,5-Di-tert-octylhydroquinone (4.5) |
| Green-Sensitive Layer: Green-Sensitized Silver Halide (10); Gelatin (132); Coupler Solvent Tri-cresyl phosphate (12.5); Coupler 1-2,4,6-Tri-chlorophenyl)-3-{5-[α-(3-tert-butyl-4-hydroxy-phenoxy)tetradecaneamido]-2-chloroanilino}-5-pyrazolone (25) |
| Gelatin (100); 3,5-Di-tert-octylhydroquinone (5.0) |
| Blue-Sensitive Layer: Silver Halide (16); Gelatin (122); Coupler Solvent Di-n-butyl phthalate (15); Coupler α-Pivalyl-4-(4-benzyloxyphenylsulfonyl)-phenoxy-2-chloro-5-[γ-2,4-di-tert-amylphenoxy)-butyramido]acetanilide (60) |
| Paper Support |

B. A first sample of the photographic element was exposed with red, green and blue light sources each focused on a separate portion of the element through a graduated-density test object having 21 equal density steps ranging from 0 density at Step 1 to a density of 3.0 at Step 21. The exposed sample was then developed for 2 minutes in a black-and-white developer of the composition set forth below in Table 6.

Table 6

| Black-and-White Developer | |
|---|---|
| $Na_2SO_3$ | 5.0 g |
| p-methylaminophenol sulfate* | 2.0 g |
| $Na_2CO_3$ | 20.0 g |
| KBr | 0.2 g |
| Water to 1 liter (pH 10.6) | |

*Commercially available from Eastman Kodak Company under the trademark Elon.

The sample was then immersed for 4 minutes in a peroxide amplification bath of the composition set forth in Table 7.

Table 7

| Peroxide Amplification Bath | |
|---|---|
| benzyl alcohol | 10.0 ml |
| $Na_2SO_3$ | 4.0 g |
| color-developing agent (CDA-1) | 5.0 g |
| $Na_2CO_3$ | 40.0 g |
| KBr | 2.0 g |
| 30% (by weight) $H_2O_2$ in water | 2.0 ml |
| water to 1 liter (pH 12.5) | |

The sample was then washed for 1 minute in water and immersed for 2 minutes in a bleach-fix solution of the composition set forth in Table 8.

Table 8

| Bleach-Fix Bath | |
|---|---|
| diaminopropanoltetraacetic acid | 3 g |
| acetic acid | 20 ml |
| $(NH_4)_2S_2O_3$ (60% aqueous soln) | 150 ml |
| $Na_2SO_3$ | 15 g |
| $[Co(NH_3)_6]Cl_3$ | 3 g |

Table 8-continued

| Bleach-Fix Bath |
|---|
| water to 1 liter (pH 4.5) |

The sample was then washed with water for 1 minute, placed in a stabilization bath of the composition set forth in Table 9 for 1 minute, washed with water again for 1 minute and then allowed to dry.

Table 9

| Stabilization Bath | |
|---|---|
| KOH (45% by weight solution) | 5.97 g |
| benzoic acid | 0.34 g |
| acetic acid | 13.1 g |
| citric acid | 6.25 g |
| water to 1 liter (pH 3.5) | |

The processed sample did not contain a dye image. This illustrated that the silver image which was formed during black-and-white development was not a catalyst for the peroxide oxidizing agent incorporated in the peroxide amplification bath.

C. A second sample identical with that of paragraph 4-B above was similarly exposed, developed and examined as in paragraph 4-B, but with the exception that the black-and-white developing solution now contained in addition 1 gram of cobalt hexammine acetate.

Figure 2:
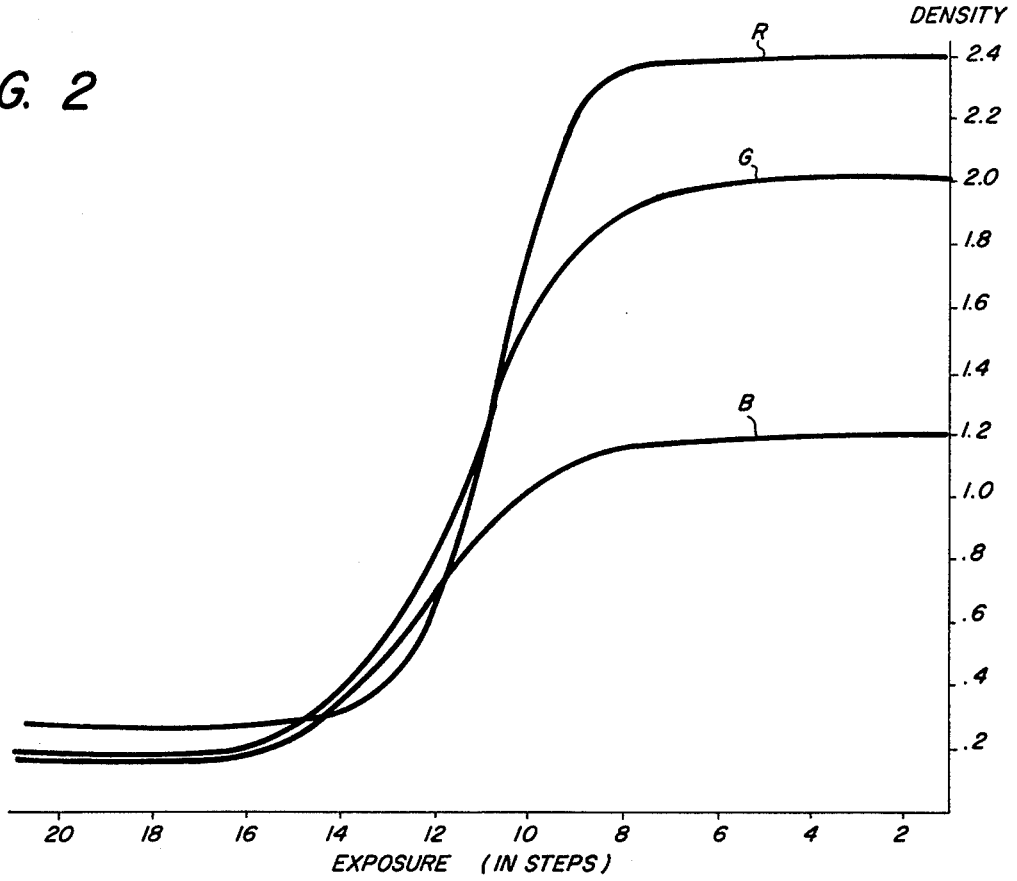

The dye images produced are shown in FIG. 2 in terms of the characteristic curves R, G and B which represent the cyan, magenta and yellow dye images, respectively, produced in the initially red-, green- and blue-sensitive silver halide emulsion layers of the second sample.

It is believed that the image-dye generation can be accounted for by the following reactions, wherein the first two reactions occurred in the black-and-white developer and the remaining three reactions occurred in the peroxide amplification bath:

$$B+W\ DEV + AgX\cdot \rightarrow AG^{\bullet} + B+W\ DEV_{ox} \quad (a)$$

$$[Co(NH_3)_6]^{+3} + B+W\ DEV \rightarrow Co(II)RP + B+W\ DEV_{ox} + 6NH_3 \quad (b)$$

$$2\ CO(II)RP + H_2O_2 \rightarrow 2\ Co(III)OA + 2\ OH^- \quad (c)$$

$$Co(III)OA + COL\text{-}DEV \rightarrow Co(II)RP + COL\text{-}DEV_{ox} \quad (d)$$

$$COL\text{-}DEV_{ox} + Coupler \rightarrow IMAGE\ DYE \quad (e)$$

EXAMPLE 5 - A SEQUENTIAL MODE WITH FIXING BEFORE AMPLIFICATION

A. A first sample from a photographic element identical with that of paragraph 4-A was exposed as in paragraph 4-B. The exposed sample was then developed for 4 minutes in a black-and-white developer of the composition of Table 6. The sample was immersed for 1 minute in dilute acetic acid stop bath and then transferred to a fix bath of the composition set forth in Table 10 for 2 minutes.

Table 10

| Fix-Bath | |
|---|---|
| $Na_2S_2O_3$ (hypo) | 240.0 g |
| sodium sulfite | 10.0 g |
| sodium bisulfite | 25.0 g |
| water to 1 liter | |

The sample was washed in water for 5 minutes and then returned to the black-and-white developer for 4 minutes. The sample was immersed for 4 minutes in a peroxide amplification bath of the composition set forth in Table 7. The sample was washed for 1 minute in water and then immersed for 2 minutes in a bleach-fix solution of the composition set forth in Table 8. The sample was washed for 1 minute and then allowed to dry. As in paragraph 4-B, no dye image was formed because the black-and-white developed silver was not a catalyst for the peroxide oxidizing agent.

Figure 3:
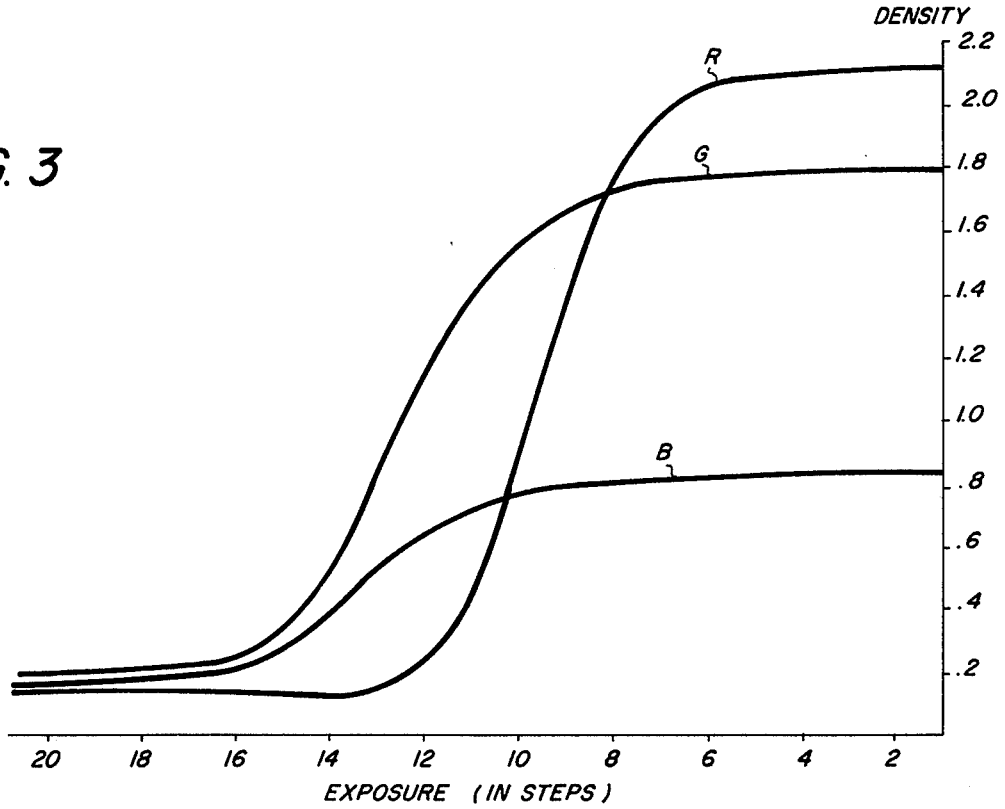

B. A second sample identical with that of paragraph 5-A was similarly exposed, developed and examined, with the exception of adding 1.0 gram of cobalt hexammine acetate to the second black-and-white developer solution employed. In this case a dye image was formed as shown in FIG. 3, wherein the curves are comparable with those of FIG. 2. The results illustrate that amplification can be obtained according to the invention where the silver halide has been fixed prior to introduction of the photographic element into the peroxide amplification bath. As compared with Example 4, the results further show that separating development and cobalt(III) complex redox amplification is feasible. The same reactions are believed to occur as indicated in paragraph 4-C, but reaction of equation (a) occurs only in the first black-and-white developer solution, and the reaction of equation (b) occurs only in second black-and-white developer solution. The reactions of equations (c), (d) and (e) occur in the peroxide amplification bath.

Figure 4:
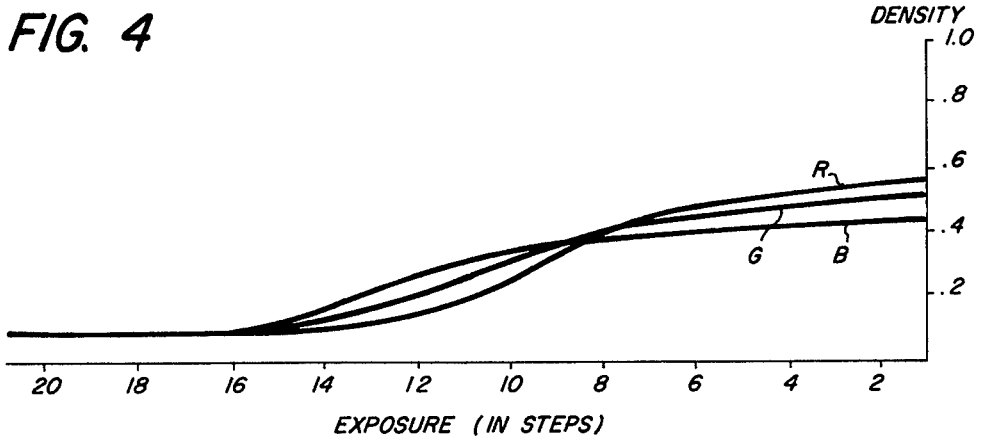

C. A third sample identical with that of paragraph 5-B was similarly exposed, developed and examined, with the exception that the black-and-white developing agent (Elon) was omitted from the second black-and-white developer solution in which the cobalt hexammine acetate was present. The purpose of this experiment was to determine whether amplification could be attributed to the cobalt(III) complex's being carried over from the first amplification bath, in this case the black-and-white developer solution containing cobalt hexammine acetate, into the peroxide amplification bath. A low-density dye image was obtained, as is illustrated by FIG. 4, wherein the curves are comparable with those of FIGS. 2 and 3. The experiment indicated that, while some cobalt(III) complex redox amplification may be taking place in the peroxide amplification bath, this alone cannot account for the substantially greater dye densities, as shown above in FIGS. 2 and 3, obtained where the cobalt(III) complex is present with a reducing agent in a processing solution brought into contact with the photographic element being processed before the photographic element is introduced into the peroxide amplification bath.

EXAMPLE 6 - A COMBINED AMPLIFICATION MODE

A. A photographic element of the structure set forth in paragraph 4-A above was exposed as described in paragraph 4-B. A sample of the photographic element was processed as follows: The sample was placed in a black-and-white developer solution of the composition set forth in Table 11 for 1 minute.

Table 11

| Black-and-White Developer | |
|---|---|
| $NaHSO_3$ | 8 g |
| 1-phenyl-3-pyrazolidone | 0.35 g |

Table 11-continued

| Black-and-White Developer | |
|---|---|
| $Na_2SO_3$ | 37 g |
| hydroquinone | 5.5 g |
| $Na_2CO_3$ | 28.2 g |
| NaSCN | 1.38 g |
| NaBr | 1.3 g |
| KI (1%) | 13 ml |
| water to 1 liter (pH 9.9) | |

The sample was placed in a dilute acetic acid stop bath for 1 minute and then fixed for 2 minutes in a fix bath of the composition set forth in Table 6. The sample was washed for 2 minutes and then placed in a color-developer solution of the composition set forth in Table 12 for 8 minutes.

Table 12

| Color Developer | |
|---|---|
| $Na_2SO_3$ | 8.0 g |
| color-developing agent (CDA-1) | 2.0 g |
| $Na_2CO_3$ | 20.0 g |
| water to 1 liter (pH 11.5) | |

The sample was placed in a dilute acetic acid stop bath for 1 minute and then washed in water for 2 minutes. The sample was placed in a bleach-fix bath of the composition set forth in Table 8 for 2 minutes, washed for 2 minutes and allowed to dry.

As expected, no dye image was formed, since treatment of the photographic element after fixing in a color developer lacking an oxidizing agent does not produce oxidized color-developing agent.

B. A second sample identical to that of paragraph 6-A was similarly processed and examined, except that 10.0 ml of 30 percent by weight hydrogen peroxide in water were added to the color developer per liter of solution. No dye image was formed, indicating that the black-and-white developed silver was incapable of acting as a heterogeneous catalyst for the peroxide amplification reaction, probably as a result of poisoning of the catalyst surface.

Figure 5:
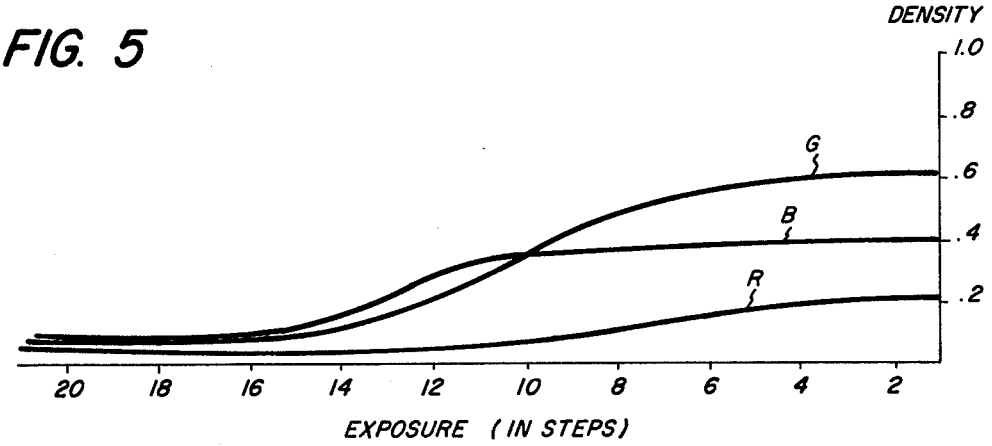

C. A third sample identical with that of paragraph 6-A was similarly processed and examined, except 2.0 grams of cobalt hexammine acetate were added to the color developer per liter of solution. The result shows that a comparatively low-density dye image was produced, as illustrated in FIG. 5, wherein the curves are comparable with those described above.

It is believed that the reactions occurring in the color-developer solution contributing to dye formation can be accounted for by the following equations:

$$[Co(NH_3)_6]^{+3} + \text{COL-DEV} \rightarrow \text{Co(II)RP} + \text{COL-DEV}_{ox} \quad \text{(a)}$$

$$\text{COL-DEV}_{ox} + \text{Coupler} \rightarrow \text{IMAGE DYE (DYE 2 of Eq. 6)} \quad \text{(b)}$$

Figure 6:
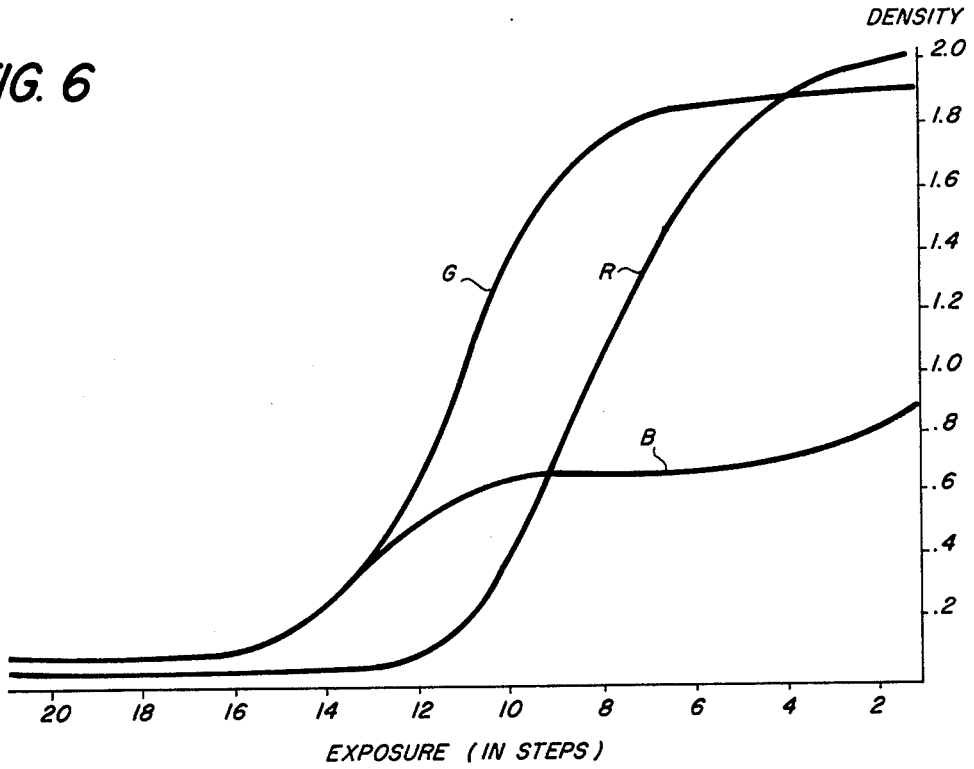

D. A fifth sample identical with that of paragraph 6-A was similarly processed and examined, except that the color developer contained both 10.0 ml of hydrogen peroxide and 2.0 grams of cobalt hexammine acetate per liter of solution. The results are shown in FIG. 6, wherein the curves are comparable with those described above. Comparing the curves of FIGS. 5 and 6, it is apparent that a significant enhancement of dye image density is produced by employing a combination of cobalt(III) complex and peroxide oxidizing agents.

It is believed that the reactions occurring in the color-developer solution contributing to dye formation can be accounted for by the following equations:

$[Co(NH_3)_6]^{+3}$ + COL-DEV → Co(II)RP + $COL\text{-}DEV_{ox}$ (a)

$COL\text{-}DEV_{ox}$ + Coupler → IMAGE DYE (DYE 2 of Eq. 6) (b)

2 Co(II)RP + $H_2O_2$ → 2 Co(III)OA + 2 $OH^-$ (c)

Co(III)OA + COL-DEV → Co(II)RP + $COL\text{-}DEV_{ox}$ (d)

$COL\text{-}DEV_{ox}$ + Coupler → IMAGE DYE (DYE 4 of Eq. 8) (e)

EXAMPLE 7 - A COMBINED COLOR DEVELOPMENT-FIRST AMPLIFICATION MODE

A. A photographic element of the structure set forth in paragraph 4-A above was exposed as described in paragraph 4-B. A sample of the photographic element was processed as follows: The sample was processed for 2 minutes in a color-developer solution of the composition set forth in Table 13.

Table 13

| Color Developer | |
|---|---|
| benzyl alcohol | 10.0 ml |
| $Na_2SO_3$ | 4.0 g |
| color-developing agent (CDA-1) | 5.0 g |
| $Na_2CO_3$ | 40.0 g |
| water to 1 liter (pH 12.5) | |

Figure 7:
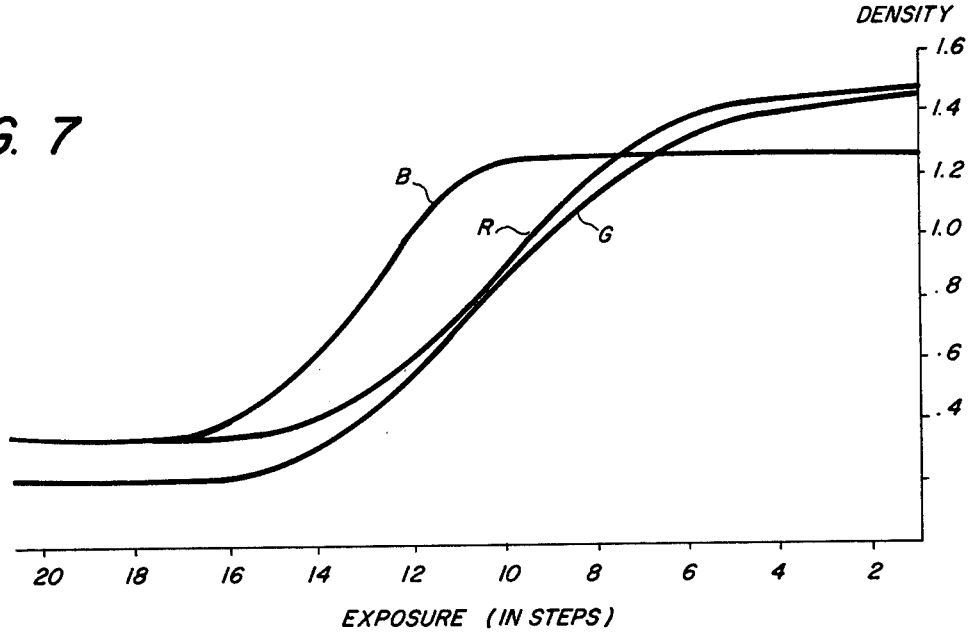

The sample was washed for 1 minute in water and then immersed in a bleach-fix bath of the composition set forth in Table 8 for 2 minutes. The sample was washed for 1 minute in water and allowed to dry. A dye image was formed as illustrated in FIG. 7, wherein the curves are comparable with those of the preceding figures.

It is believed that dye-image generation can be accounted for by the following reactions:

COL-DEV + AgX· → $Ag^*$ + $COL\text{-}DEV_{ox}$ (a)

$COL\text{-}DEV_{ox}$ + Coupler → IMAGE DYE (DYE 1 of Eq. 5) (b)

Figure 8:
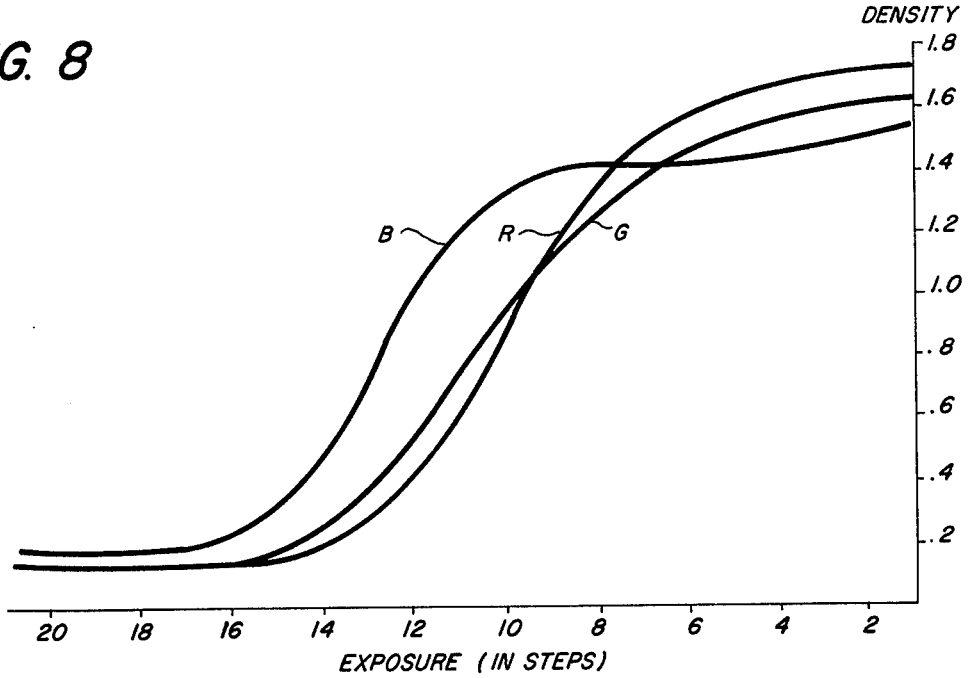

B. A second sample identical with that of paragraph 7-A was similarly processed and examined, except 2.0 grams of cobalt hexammine acetate were added to the color developer per liter of solution. The results show that significantly higher density dye images were produced, as illustrated in FIG. 8, wherein the curves are comparable with those of FIG. 7.

It is believed that dye-image generation can be accounted for by the following reactions:

COL-DEV + AgX· → $Ag^*$ + $COL\text{-}DEV_{ox}$ (a)

$COL\text{-}DEV_{ox}$ + Coupler → IMAGE DYE (DYE 1 of Eq. 5) (b)

$[Co(NH_3)_6]^{+3}$ + COL-DEV → Co(II)RP + $COL\text{-}DEV_{ox}$ (c)

$COL\text{-}DEV_{ox}$ + Coupler → IMAGE DYE (DYE 2 of Eq. 6) (d)

Figure 9:
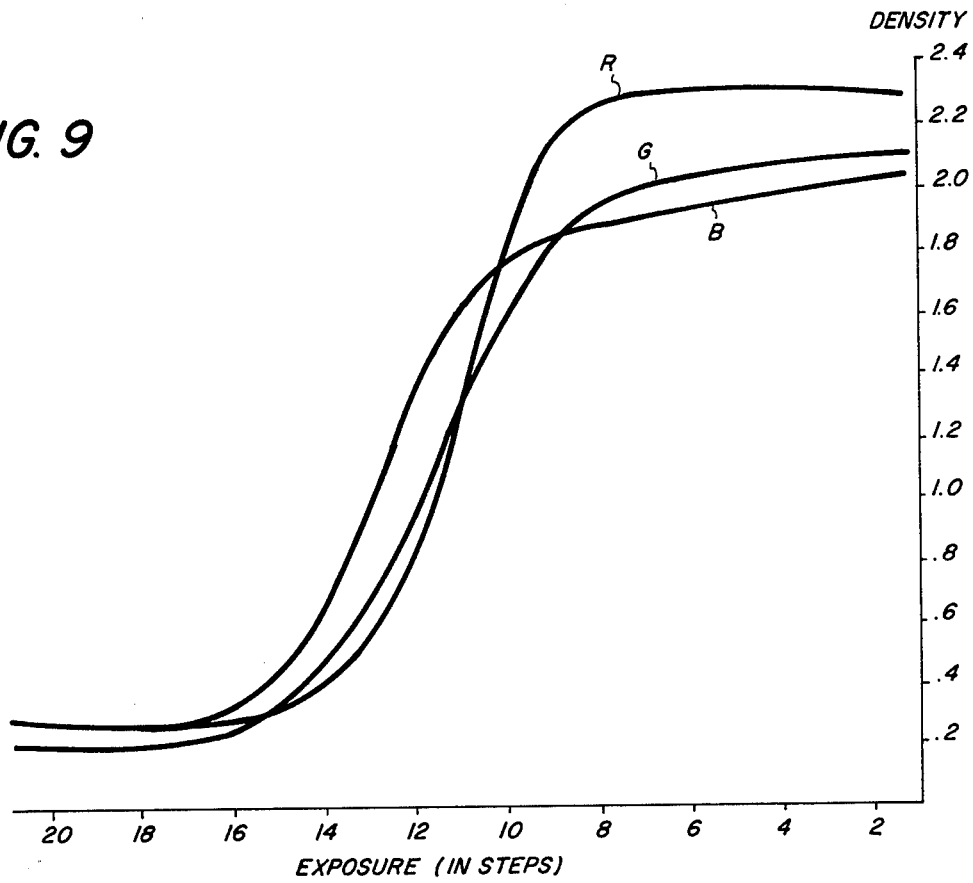

C. A third sample identical with that of paragraph 7-A was similarly processed and examined, except that cobalt(III) complex was added to the color developer, as described in paragraph 7-B, and processing was conducted for 2 minutes in a peroxide amplification bath of the composition set forth in Table 7 immediately following the step of color development. The results show that considerably higher density dye images were produced, as illustrated in FIG. 9, where the curves are comparable with those of FIGS. 7 and 8.

It is believed that dye-image generation can be accounted for by the following reactions:

COL-DEV + AgX· → $Ag^*$ + $COL\text{-}DEV_{ox}$ (a)

$COL\text{-}DEV_{ox}$ + Coupler → IMAGE DYE (DYE 1 of Eq. 5) (b)

$[Co(NH_3)_6]^{+3}$ + COL-DEV → Co(II)RP + $COL\text{-}DEV_{ox}$ (c)

$COL\text{-}DEV_{ox}$ + Coupler → IMAGE DYE (DYE 2 of Eq. 6) (d)

2 Co(II)RP + $H_2O_2$ → 2 Co(III)OA + 2 $OH^-$ (e)

Co(III)OA + COL-DEV → Co(II)RP + $COL\text{-}DEV_{ox}$ (f)

$COL\text{-}DEV_{ox}$ + Coupler → IMAGE DYE (DYE 4 of Eq. 8) (g)

In addition, the silver image may have catalyzed the peroxide oxidizing agent to react directly with the color-developing agent; however, no verification of this reaction was attempted in this experiment.

EXAMPLE 8 - A COLOR IMAGE TRANSFER APPLICATION EMPLOYING REDOX DYE-RELEASERS

A. A color image transfer photographic element having a film support and, coated thereon, a mordant layer, a reflective layer and a gelatino-silver halide emulsion layer was prepared. The layers were of the composition set forth in Table 14.

Table 14

| Color Image Transfer Photographic Element 8-A |
|---|
| Gelatino-Silver Halide Emulsion Layer: Silver Halide (10); Magenta Redox Dye-Releaser* (60); Gelatin (200) |
| Reflective Layer: Titanium Dioxide (2000); Gelatin (300) |
| Mordant Layer: Poly[styrene-co-N-benzyl-N,N-dimethyl-N-vinyl benzyl-co-divinyl benzene]latex (200); Gelatin (200) |
| Transparent Poly(Ethylene Terephthalate) Film Support |

*

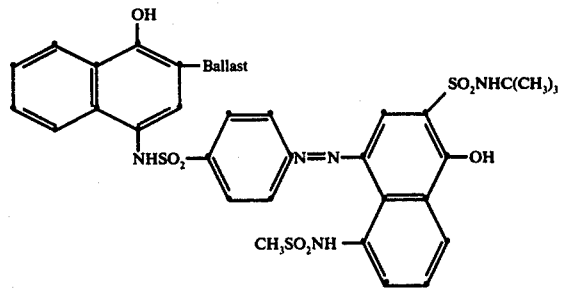

B. A first sample of the photographic element was exposed with a white light source through a graduated-density test object having 21 equal density steps ranging from 0 density at Step 1 to a density of 6.0 at step 21. The sample was then immersed for 30 seconds in a development bath comprised of the ingredients set forth below in Table 15.

Table 15

| Developer | |
|---|---|
| 11-Aminoundecanoic Acid | 2.0 g |
| $Na_2SO_3$ | 0.5 g |
| Hydroxylamine sulfate | 1.0 g |
| Sodium Carbonate | 20.0 g |
| Diaminopropanol tetra-acetic acid | 0.5 g |
| 5-Methylbenzotriazole | 0.2 g |
| p-Methylaminophenol sulfate | 2.0 g |
| Water to 1 liter (pH 11.5) | |

Figure 10:
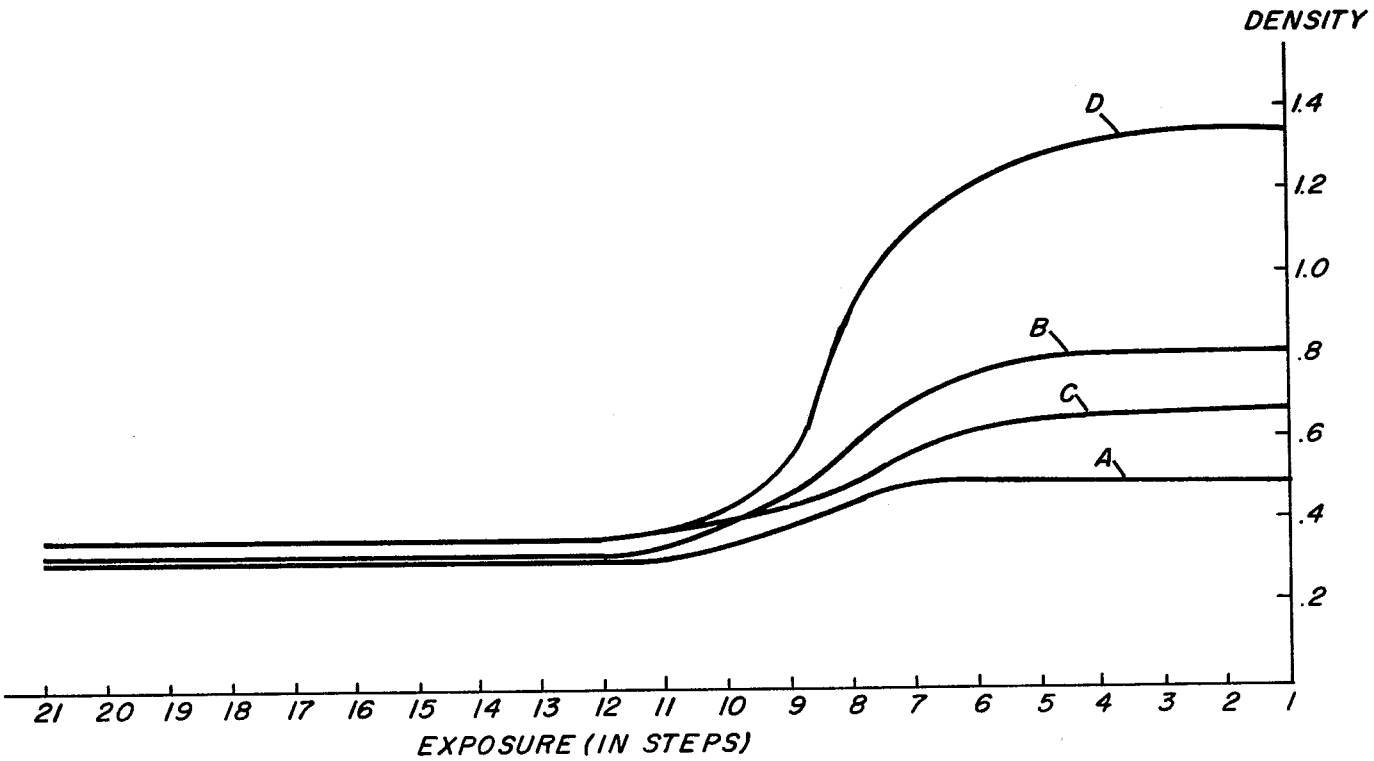

Upon removal from the processing solution, a piece of poly(ethylene terephthalate) film support was laid over the emulsion layer to serve as a cover sheet. After 2 minutes the cover sheet was removed and the processed sample was fixed for 15 seconds in a fix bath of the composition set forth in Table 10, washed and dried. A transferred dye image was obtained, as is illustrated by Curve A in FIG. 10.

C. The procedure of paragraph 8-B was repeated with a second sample of the photographic element, except that 10.0 ml per liter of 30 percent by weight hydrogen peroxide in water was added to the developer solution. A transferred dye image was obtained. The results are illustrated as Curve B in FIG. 10.

D. The procedure of paragraph 8-B was repeated with a third sample of the photographic element, except that 2.0 grams per liter of cobalt hexammine acetate was added to the developer solution. A transferred dye image was obtained. The results are illustrated as Curve C in FIG. 10.

E. The procedure of paragraph 8-B was repeated with a fourth sample of the photographic element, except that 10.0 ml per liter of 30 percent by weight hydrogen peroxide in water and 2.0 grams per liter of cobalt hexammine acetate were added to the developer solution. A transferred dye image was obtained. The results are illustrated as Curve D in FIG. 10. It is to be noted that the enhancement in the maximum dye image density obtained using the cobalt and peroxide oxidizing agents in combination is more than the sum of maximum dye image enhancements using cobalt and peroxide oxidizing agents separately.

Although the invention has been described in considerable detail with particular reference to certain preferred embodiments thereof, variations and modifications can be effected within the spirit and scope of the invention.

I claim:

1. A method of forming an image comprising:

in a first aqueous alkaline solution performing a first redox reaction by bringing a cobalt(III) complex, which permanently releases ligands upon reduction, and a reducing agent together and into contact with an element containing an image pattern of a heterogeneous catalyst, wherein the cobalt(III) complex and the reducing agent are chosen so that they are essentially inert to oxidation-reduction in the absence of the heterogeneous catalyst, and permitting the selective reaction of the cobalt(III) complex and the reducing agent at the site of the heterogeneous catalyst to produce cobalt(II) as an immobile reaction product in a pattern conforming to the heterogeneous catalyst image pattern; and in a second aqueous alkaline solution performing a second redox reaction by bringing into material contact a peroxide oxidizing agent, the immobile cobalt(II) reaction product and a dye-image-generating reducing agent capable of producing a dye-image-generating reaction product, wherein the peroxide oxidizing agent and the dye-image-generating reducing agent are chosen so that they are essentially inert to oxidation-reduction in the absence of a catalyst, and permitting the selective reaction of the peroxide oxidizing agent and the dye-image-generating reducing agent in a pattern conforming to the heterogeneous catalyst image pattern to permit a corresponding dye image to be formed, wherein each of the first and second redox reactions is performed in an aqueous alkaline solution.

2. A method according to claim 1 wherein the reducing agent employed in the first redox reaction is a dye-image-generating reducing agent.

3. A method according to claim 2 wherein the aqueous alkaline solution employed in performing each of the redox reactions is sufficiently alkaline to immobilize substantially completely the cobalt(II) reaction product.

4. A method according to claim 2 wherein the aqueous alkaline solution employed in performing each of the redox reactions exhibits a pH of at least 10.

5. A method according to claim 1 wherein the cobalt(III) complex contains only monodentate and/or bidentate ligands.

6. A method according to claim 5 wherein the cobalt(III) complex is incorporated in an aqueous alkaline solution used in performing the first redox reaction.

7. A method according to claim 1 wherein the dye-image-generating reducing agent is comprised of a color-developing agent which, in its oxidized form, is capable of reacting with a color coupler to form a dye.

8. A method according to claim 7 wherein the color-developing agent is incorporated in an aqueous alkaline solution employed in the second redox reaction and the color coupler is incorporated in the photographic element being processed.

9. A method according to claim 1 wherein the reducing agent employed in the first redox reaction is a silver halide developing agent.

10. A method according to claim 9 wherein the silver halide developing agent employed in the first redox reaction is a color-developing agent.

11. A method according to claim 1 wherein the dye-image-generating reducing agent is a redox dye-releaser.

12. A method of forming an image comprising:

developing in the presence of a developing agent to produce a silver image pattern, an imagewise-exposed photographic element comprised of a support and at least one radiation-sensitive silver halide layer containing a developable latent image therein;

performing a first redox reaction by bringing a cobalt(III) complex, which permanently releases ligands upon reduction, and a reducing agent together and into contact with the element containing the silver image pattern, and permitting the selective reaction of the cobalt(III) complex and the reducing agent at the site of the silver image pattern to produce cobalt(II) as an immobile reaction product in a pattern conforming to the silver image pattern; and performing a second redox reaction by bringing into material contact a peroxide oxidizing agent, the immobile cobalt(II) reaction product and a dye-image-generating reducing agent capable of producing a dye-image generating reaction product, and permitting the selective reaction of the peroxide oxidizing agent and the dye-image-generating reducing agent in a pattern conforming to the silver image pattern to permit a corresponding dye image to be formed, wherein each of the developing, first redox reaction and second redox reaction steps is performed using a common aqueous alkaline processing solution and the cobalt(III) complex, peroxide oxidizing agent, reducing agent and dye-image-generating reducing agent are chosen so that they are essentially inert to oxidation-reduction in the absence of a catalyst.

13. A method according to claim 12 wherein a black-and-white developing agent is employed to produce a silver image.

14. A method according to claim 12 wherein the silver halide within the photographic element is fixed after the second redox reaction step is completed.

15. A method according to claim 12 wherein the dye-image-generating reducing agent is incorporated in the photographic element and is a redox dye-releaser.

16. A method of forming an image comprising:

in a first aqueous alkaline solution bringing a photographic element bearing a silver image pattern into contact with an aqueous alkaline first amplification solution containing less than a 0.5 molar concentration of any compound which will form a tridentate or higher dentate ligand with cobalt, at least one of the photographic element and the first amplification solution additionally containing a cobalt(III) complex which permanently releases ligands upon reduction and a reducing agent wherein the cobalt(III) complex and the reducing agent are chosen so that they are essentially inert to oxidation-reduction in the absence of the image silver, and in a second aqueous alkaline solution bringing the photographic element into contact with an aqueous alkaline second amplification solution comprising a peroxide oxidizing agent and at least one of the photographic element and the second amplification solution containing a dye-image-generating reducing agent, wherein the peroxide oxidizing agent and the dye-image-generating reducing agent are chosen so that they are essentially inert to oxidation-reduction in the absence of a catalyst so that a dye image can be formed conforming to the silver image pattern originally present.

17. A method according to claim 16 wherein the cobalt(III) complex has a coordination number of 6 and contains at least 4 ammine ligands.

18. A method according to claim 17 wherein the cobalt(III) complex is a cobalt hexammine complex.

19. A method according to claim 16 wherein the peroxide oxidizing agent is water-soluble.

20. A method according to claim 19 wherein the peroxide oxidizing agent is hydrogen peroxide.

21. A method according to claim 16 wherein the dye-image-generating reducing agent is comprised of a primary aromatic amine developing agent and the photographic element includes incorporated therein at least one photographic color coupler.

22. A method of forming an image comprising:

bringing a photographic element, comprised of a support and at least one radiation-sensitive silver halide layer containing a developable latent image, into contact with an aqueous alkaline developer solution, wherein at least one of the photographic element and the developer solution contains a silver halide developing agent, so that a silver image is formed in the photographic element corresponding to the developable latent image, poisoning the silver image as a redox amplification catalyst for a peroxide oxidizing agent, bringing the photographic element bearing the silver image pattern into contact with an aqueous alkaline first amplification solution containing less than a 0.05 molar concentration of any compound which will form a tridentate or higher dentate ligand with cobalt, comprising a reducing agent and at least one of the photographic element and the first amplification solution additionally containing a cobalt(III) complex which permanently releases ligands upon reduction, wherein the cobalt(III) complex and the reducing agent are chosen so that they are essentially inert to oxidation-reduction in the absence of the image silver, and thereafter bringing the photographic element into contact with an aqueous alkaline second amplification solution, separate from said first amplification solution, comprising a peroxide oxidizing agent capable of reacting with the cobalt(II) reaction product to form a cationic cobalt(III) oxidizing agent as a reaction product in a pattern conforming to the silver image pattern and at least one of the photographic element and the second amplification solution containing a dye-image-generating reducing agent capable of entering into a redox reaction with the cationic cobalt(III) oxidizing agent, wherein the peroxide oxidizing agent and the dye-image-generating reducing agent are chosen so that they are essentially inert to oxidation-reduction in the absence of the cobalt(II) reaction product, so that a dye image can be formed.

23. A method according to claim 22 wherein the developing agent is a black-and-white developing agent.

24. A method according to claim 22 wherein the dye-image-generating reducing agent is a color-developing agent contained within the aqueous alkaline second amplification solution and the photographic element contains at least one color coupler.

25. A method according to claim 22 wherein the steps of developing and first amplification are performed using a single aqueous alkaline processing solution having a pH of at least 10 and the cobalt(III) complex, the silver halide developing agent and the reducing agent are chosen so that they are essentially inert to oxidation-reduction in the absence of a catalyst.

26. A method according to claim 22 wherein the reducing agent employed in the aqueous alkaline first amplification solution is a dye-image-generating reducing agent.

27. A method according to claim 26 wherein the dye-image-generating reducing agent employed in the first amplification solution is a color-developing agent.

28. A method according to claim 22 wherein the developer solution is a color developer.

29. A method of forming an image comprising: bringing a photographic element bearing a silver image pattern into contact with an aqueous alkaline first amplification solution having a pH in the range of from 10 to 13 containing less than a 0.05 molar concentration of any compound which will form a tridentate or higher dentate ligands with cobalt and comprising a silver halide developing agent as a reducing agent, at least one of the photographic element and the aqueous alkaline first amplification solution comprising a cobalt(III) complex having a coordination number of 6 and only monodentate or bidentate ligands, at least 4 of the ligands being ammine ligands, thereafter bringing the photographic element into contact with an aqueous alkaline second amplification solution having a pH in the range of from 10 to 13 and containing a peroxide oxidizing agent, at least one of the photographic element and the second amplification solution containing a color-developing agent and a photographic color coupler, and bleaching at least a portion of the silver halide image to leave an amplified image comprised of image dye, wherein the cobalt(III) complex and the silver halide developing agent are essentially inert to oxidation-reduction in the absence of a catalyst and the peroxide oxidizing agent and the color-developing agent are essentially inert to oxidation-reduction in the absence of a catalyst.

30. A method according to claim 29 wherein the cobalt(III) complex is cobalt hexammine.

31. A method according to claim 29 wherein the peroxide oxidizing agent is hydrogen peroxide present in a concentration of from about 0.001 to 0.5 mole per liter.

32. A method of forming an image comprising:

bringing a photographic element comprised of a support and at least one radiation-sensitive silver halide emulsion layer containing a developable latent image into contact with an aqueous alkaline developer solution having a pH in the range of from 10 to 13, wherein at least one of the photographic element and the developer solution contains a silver halide developing agent, so that a silver image is formed in the photographic element corresponding to the developable latent image, bringing the photographic element into contact with an aqueous alkaline first amplification solution having a pH in the range of from 10 to 13 containing less than a 0.05 molar concentration of any compound which will form a tridentate or higher dentate ligand with cobalt and containing a developing agent as a reducing agent, at least one of the photographic element and the aqueous alkaline first amplification solution comprising a cobalt(III) complex having a coordination number of 6 and only monodentate or bidentate ligands, at least 4 of the ligands being ammine ligands, thereafter bringing the photographic element into contact with an aqueous alkaline amplification solution having a pH in the range of from 10 to 13 and containing a peroxide oxidizing agent and a primary aromatic amine, at least one of the photographic element and the amplification solution containing a photographic color coupler, and bleaching at least a portion of the silver image to leave an amplified image comprised of image dye, wherein the cobalt(III) complex and the silver halide developing agent are essentially inert to oxidation-reduction in the absence of a catalyst.

33. A method according to claim 32 wherein the aqueous alkaline first amplification solution initially contains less than a 0.01 molar concentration of any compound which will form a tridentate or higher dentate ligand with cobalt.

34. A method according to claim 32 wherein the developer solution and the first amplification solution are formed by a common aqueous alkaline solution and the second amplification solution is formed by a separate aqueous alkaline solution.

35. A method according to claim 32 wherein the developer solution, the first amplification solution and the second amplification solution are each formed by separate aqueous alkaline processing solutions.

36. A method of forming a multicolor dye image in a photographic element comprised of a support and, coated thereon, at least three layer units each comprised of at least one silver halide emulsion layer containing a developable latent image pattern, each of said layer units being primarily responsible to a different one of the blue, green and red portions of the visible spectrum, the blue-sensitive layer unit containing a yellow-dye-forming color coupler, the green-sensitive layer unit containing a magenta-dye-forming color coupler and the red-sensitive layer unit containing a cyan-dye-forming color coupler, comprising:

developing a silver image in each of the three layer units corresponding to the latent image pattern thereof;

with a first aqueous alkaline processing solution performing a first redox reaction in each of the layer units by bringing a cobalt(III) complex, which permanently releases ligands upon reduction, and a reducing agent together and into contact with the element containing the silver image pattern in each layer unit, wherein the cobalt(III) complex and the reducing agent are chosen so that they are essentially inert to oxidation-reduction in the absence of the silver image, and permitting the selective reaction of the cobalt(III) complex and the reducing agent at the site of the silver image pattern within each layer unit to produce cobalt(II) as an immobile reaction product in a pattern conforming to the silver image pattern in each layer unit; and thereafter, with a second aqueous alkaline processing solution performing a second redox reaction by bringing into mutual contact a peroxide oxidizing agent, the immobile cobalt(II) reaction product and a dye-image-generating reducing agent capable of producing a dye-image-generating reaction, wherein the peroxide oxidizing agent and the dye-image-generating reducing agent are chosen so that they are essentially inert to oxidation-reduction in the absence of a catalyst, and permitting the selective reaction of the peroxide oxidizing agent and the dye-image-generating reducing agent in a pattern conforming to the silver image pattern in each of the layer units to permit a corresponding dye image to be formed therein.

37. A method according to claim 36 wherein the first aqueous alkaline amplification solution contains less than a 0.05 molar concentration of any compound which will form a tridentate or higher dentate chelate with cobalt.

38. A method according to claim 36 wherein each layer unit contains from about 1.0 to 325 milligrams per square meter of silver halide.

39. A method according to claim 38 wherein each layer unit contains at least a 40% stoichiometric exess of the color coupler based on the weight of silver halide present.

40. A method according to claim 36 wherein the silver halide is fixed and the silver image is bleached.

41. A method of forming a multicolor dye image in a photographic element comprised of a support and, coated thereon, at least three layer units each comprised of at least one gelatino-silver halide emulsion layer, each of said layer units being primarily responsive to a different one of the blue, green and red portions of the visible spectrum, the blue-sensitive layer unit containing an open-chain ketomethylene yellow-dye-forming color coupler, the green-sensitive layer unit containing a 5-pyrazolone magenta-dye-forming color coupler and the red-sensitive layer unit containing a phenolic cyan-dye-forming color coupler, and at least one of the layer units containing a developable latent image, comprising sequentially:

bringing the photographic element into contact with an aqueous alkaline developer solution having a pH in the range of from 10 to 13 wherein at least one of the photographic element and the developer solution contains at least one silver halide developing agent, so that a silver image is formed in the photographic element corresponding to the developable latent image, bringing the photographic element into contact with an aqueous alkaline first amplification solution having a pH in the range of from 10 to 13 containing less than a 0.05 molar concentration of any compound which will form a tridentate or higher dentate ligand with cobalt and comprising a silver halide developing agent as a reducing agent, at least one of the photographic element and the aqueous alkaline first amplification solution comprising a cobalt(III) complex having a coordination number of 6 and only monodentate or bidentate ligands, at least 4 of the ligands being ammine ligands, wherein the cobalt(III) complex and the silver halide developing agent are chosen so that they are essentially inert to oxidation-reduction in the absence of a catalyst, thereafter bringing the photographic element into contact with a separate aqueous aklaline second amplification solution having a pH in the range of from 10 to 13 and containing hydrogen peroxide and a primary para-phenylenediamine color-developing agent, and bleaching at least a portion of the silver image in each of the three layer units to leave an amplified image comprised of image dye.

42. A method according to claim 41 wherein the cobalt(III) complex is present as cobalt hexammine acetate or chloride in a concentration of from about 0.2 to 20 grams per liter of the bleach-fix solution.

43. The method according to claim 41 wherein the hydrogen peroxide is present in a concentration of from 0.001 to 0.5 mole per liter of the second amplification solution.

44. A method of forming a multicolor dye image in a photographic element comprised of a support and, coated thereon, at least three layer units each comprised of at least one gelatino-silver halide emulsion layer, each of the layer units incorporating therein a silver image formed by exposure to a separate one of the blue, green and red thirds of the visible spectrum, the layer unit containing the silver image formed by exposure to the blue third of the visible spectrum containing an open-chain ketomethylene yellow-dye-forming color coupler, the layer unit containing the silver image formed by exposure to the green third of the visible spectrum containing a 5-pyrazolone magenta-dye-forming color coupler and the layer unit containing the silver image formed by exposure to the red third of the visible spectrum containing a phenolic cyan-dye-forming color coupler, comprising:

bringing the photographic element into contact with an aqueous alkaline first amplification solution having a pH in the range of from 10 to 13 which is substantially free from any compound which will form a tridentate or higher dentate ligand with cobalt and comprising from 1 to 20 grams per liter of a silver halide developing agent and from 0.2 to 20 grams per liter of cobalt hexammine acetate or chloride, and thereafter bringing the photographic element into contact with an aqueous alkaline second amplification solution separate from the first aqueous alkaline amplification solution having a pH in the range of from 10 to 13 containing 0.001 to 0.5 mole per liter of hydrogen peroxide and 1 to 20 grams per liter of a primary para-phenylenediamine color-developing agent, thereby forming the silver image in each layer unit with a dye image corresponding to the silver image pattern therein.

45. A color diffusion transfer method comprising developing a silver image in at least one silver halide emulsion layer coated on a photographic support and containing a developable latent image pattern, performing a first redox reaction by bringing a cobalt(III) complex, which permanently releases ligands upon reduction, and a reducing agent together and into contact with the silver image, wherein the cobalt(III) complex and the reducing agent are chosen so that they are essentially inert to oxidation-reduction in the absence of the silver image, and permitting the selective reaction of the cobalt(III) complex and the reducing agent at the site of the silver image within the emulsion layer to produce cobalt(II) as an immobile reaction product in a pattern conforming to the silver image;

performing a second redox reaction by bringing into mutual contact a peroxide oxidizing agent, the immobile cobalt(II) reaction product and a dye-image-generating reducing agent capable of producing a dye-image-generating reaction, wherein the peroxide oxidizing agent and the dye-image-generating reducing agent are chosen so that they are essentially inert to oxidation-reduction in the absence of a catalyst, and permitting the selective reaction of the peroxide oxidizing agent and the dye-image-generating reducing agent in a pattern conforming to the silver image pattern to permit a corresponding dye image to be formed in the emulsion layer; and selectively transferring one of the dye image and the residual dye-image-generating reducing agent to a receiver for viewing, wherein each of the first and second redox reactions is performed in an aqueous alkaline processing solution.

46. A color diffusion transfer method comprising developing a silver image in at least one silver halide emulsion layer coated on a photographic support and containing a developable latent image pattern, performing a first redox reaction by bringing a cobalt(III) complex, which permanently releases ligands upon reduction, and a reducing agent together and into contact with the silver image, wherein the cobalt(III) complex and the reducing agent are chosen so that they are essentially inert to oxidation-reduction in the absence of the silver image, and permitting the selective reaction of the cobalt(III) complex and the reducing agent at the site of the silver image within the emulsion layer to produce cobalt(II) as an immobile reaction product in a pattern conforming to the silver image;

performing a second redox reaction by bringing into mutual contact a peroxide oxidizing agent, the immobile cobalt(II) reaction product and a dye-image-generating reducing agent capable of producing a dye-image-generating reaction, wherein the peroxide oxidizing agent and the dye-image-generating reducing agent are chosen so that they are essentially inert to oxidation-reduction in the absence of a catalyst, and permitting the selective reaction of the peroxide oxidizing agent and the dye-image-generating reducing agent in a pattern conforming to the silver image pattern to permit a corresponding dye image to be formed in the emulsion layer; and selectively transferring one of the dye image and the residual dye-image-generating reducing agent to a receiver for viewing, wherein development of the silver image, the first redox reaction and the second redox reaction are performed by bringing an aqueous alkaline processing solution into contact with the silver halide emulsion layer and the cobalt(III) complex, the peroxide oxidizing agent, the reducing agent and the dye-image-generating reducing agent are chosen so that they are essentially inert to oxidation-reduction in the absence of a catalyst.

47. A color diffusion transfer method according to claim 46 wherein the aqueous alkaline processing solution initially upon contact with the emulsion layer exhibits a pH in the range of from 10 to 13.

48. A color diffusion transfer method according to claim 46 wherein the emulsion layer of a processing solution permeable layer adjacent thereto contains a redox dye-releaser as the dye-image-generating reducing agent and the peroxide oxidizing agent is present in the aqueous alkaline processing solution.

49. A color diffusion transfer method according to claim 48 wherein the peroxide oxidizing agent is hydrogen peroxide.

50. A color diffusion transfer method comprising bringing into contact with a photographic element comprised of a support, at least one radiation-sensitive silver halide emulsion layer containing a developable latent image pattern and the emulsion layer or an aqueous alkaline processing solution permeable layer adjacent thereto containing a uniformly distributed redox dye-releaser, an aqueous alkaline processing solution having a pH in the range of from 10 to 13 containing less than a 0.05 molar concentration of any compound which will form a tridentate or higher chelate with cobalt, a cobalt(III) complex oxidizing agent which permanently releases ligands upon reduction, a peroxide oxidizing agent and a crossoxidizing silver halide developing agent, wherein the redox dye-releaser, the developing agent and the oxidizing agents are chosen so that they are essentially inert to oxidation-reduction in the absence of a catalyst, and selectively transferring a mobile dye image from the emulsion layer or the layer adjacent thereto to a receiver for viewing.

51. A method of forming an image comprising in a first aqueous alkaline processing solution, developing in the presence of a developing agent to produce a silver image pattern, an imagewise-exposed photographic element comprised of a support and at least one radiation-sensitive silver halide layer containing a developable latent image therein and performing a first redox reaction by bringing a cobalt(III) complex, which permanently releases ligands upon reduction, and a reducing agent together and into contact with the element containing the silver image pattern, wherein the developing agent, cobalt(III) complex and reducing agent are chosen so that they are essentially inert to oxidation-reduction in the absence of the silver image, and permitting the selective reaction of the cobalt(III) complex and the reducing agent at the site of the silver image pattern to produce cobalt(II) as an immobile reaction product in a pattern conforming to the silver image pattern; and in a second aqueous alkaline processing solution, performing a second redox reaction by bringing into material contact with a peroxide oxidizing agent, the immobile cobalt(II) reaction product and a dye-image-generating reducing agent capable of producing a dye-image-generating reaction product, wherein the peroxide oxidizing agent and the dye-image-generating reducing agent are chosen so that they are essentially inert to oxidation-reduction in the absence of a catalyst, and permitting the selective reaction of the peroxide oxidizing agent and the dye-image-generating reducing agent in a pattern conforming to the silver image pattern to permit a corresponding dye image to be formed.

52. A method according to claim 51 wherein the developing agent is also the reducing agent.

53. A method of forming an image comprising bringing a photographic element comprised of a support and at least one radiation-sensitive silver halide emulsion layer containing a developable latent image into contact with an aqueous alkaline processing solution having a pH in the range of from 10 to 13, at least one of the photographic element and the processing solution contains a photographic color coupler and a cobalt(III) complex having a coordination number of 6 and only monodentate or bidentate ligands, at least 4 of the ligands being ammine ligands, the aqueous alkaline processing solution contains a dye-image-generating primary aromatic amine silver halide developing agent, a peroxide oxidizing agent and less than a 0.5 molar concentration of any compound which will form a tridentate or higher dentate ligand with cobalt, wherein the cobalt(III) complex, the dye-image-generating developing agent and the peroxide oxidizing agent are essentially inert to oxidation-reduction in the absence of a catalyst, so that a silver image is formed in the photographic element corresponding to the developable latent image and an amplified dye image is formed which corresponds to the silver image and thereafter bleaching at least a protion of the silver image to leave the amplified dye image.

* * * * *

UNITED STATES PATENT AND TRADEMARK OFFICE

CERTIFICATE OF CORRECTION

PATENT NO. : 4,097,278

DATED : June 27, 1978

INVENTOR(S) : Vernon L. Bissonette

It is certified that error appears in the above-identified patent and that said Letters Patent are hereby corrected as shown below:

Column 1, line 25, "AgX." should read --AgX˙--; line 46, that part of the formula reading "AgX." should read --AgX˙--.

Column 2, line 49, "may" should read --my--; last line, "→" should read -- $\xrightarrow{\text{Cat.}}$ --.

Column 4, line 43, that part of the formula reading "AgX." should read --AgX˙--; line 64, that part of the formula reading "→" should read -- $\xrightarrow{\text{Ag}^{\circ}}$ --.

Column 5, line 9, that part of the formula reading "→" should read -- $\xrightarrow{\text{Ag}^{\circ}}$ --; line 59, "imagewisedistributed" should read -- imagewise-distributed --.

Column 8, line 43, "pyrazolone" (second occurrence) should be deleted.

Column 9, lines 33-34, "dye-imagegenerating" should read -- dye-image-generating --.

Column 13, line 30, "by" should read --of--.

Column 14, line 46, "capable" should read --incapable--.

Column 16, line 17, "useful solvent" should read --useful solvents--; line 22, after "March", insert -- , --.

Column 18, line 3, "by" should read --be--.

Column 19, line 39, that part of the formula reading "λ" should be -- 1 --.

UNITED STATES PATENT AND TRADEMARK OFFICE

CERTIFICATE OF CORRECTION

PATENT NO. : 4,097,278

DATED : June 27, 1978

INVENTOR(S) : Vernon L. Bissonette

It is certified that error appears in the above-identified patent and that said Letters Patent are hereby corrected as shown below:

Column 26, line 44, "in" (first occurrence) should read --is--.

Column 27, line 51, "peferred" should read --preferred--.

Column 35, line 15, "→" should read -- $\xrightarrow{Ag^{\circ}}$ --; line 34, "→" should read -- $\xrightarrow{Ag^{\circ}}$ --.

Column 38, line 40, "AG°" should read --Ag°--; line 41, "→" should read -- $\xrightarrow{Ag^{\circ}}$ --.

Column 40, line 52, "→" should read -- $\xrightarrow{Ag^{\circ}}$ --.

Column 41, line 4, "→" should read -- $\xrightarrow{Ag^{\circ}}$ --; line 63, that part of the formula reading "→" should read -- $\xrightarrow{Ag^{\circ}}$ --.

Column 42, line 18, that part of the formula reading "→" should read -- $\xrightarrow{Ag^{\circ}}$ --.

Column 45, line 12 (claim 12), "dye-image generating" should read -- dye-image-generating --.

UNITED STATES PATENT AND TRADEMARK OFFICE

CERTIFICATE OF CORRECTION

PATENT NO. : 4,097,278

DATED : June 27, 1978

INVENTOR(S) : Vernon L. Bissonette

It is certified that error appears in the above-identified patent and that said Letters Patent are hereby corrected as shown below:

Column 45, line 40 (claim 16), "0.5" should read --0.05--.

Column 48, line 8 (claim 32), after "catalyst", insert --and the peroxide oxidizing agent and the primary aromatic amine are essentially inert to oxidation-reduction in the absence of a catalyst--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*